US008740131B2

(12) United States Patent
Lawniczak et al.

(10) Patent No.: US 8,740,131 B2
(45) Date of Patent: Jun. 3, 2014

(54) PRINTER WEB MEDIUM SUPPLY WITH DRIVE SYSTEM

(75) Inventors: Gary P. Lawniczak, Rochester, NY (US); Rodney R. Bucks, Webster, NY (US); Donald S. Rimai, Webster, NY (US); Eric C. Stelter, Pittsford, NY (US); Alan E. Rapkin, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 650 days.

(21) Appl. No.: 13/015,608

(22) Filed: Jan. 28, 2011

(65) Prior Publication Data

US 2012/0195671 A1 Aug. 2, 2012

(51) Int. Cl.
*B65H 16/06* (2006.01)

(52) U.S. Cl.
USPC ..... 242/596; 242/596.7

(58) Field of Classification Search
USPC ..... 242/590, 592, 596, 596.7–596.8
See application file for complete search history.

(56) References Cited

U.S. PATENT DOCUMENTS

| | | | | | |
|---|---|---|---|---|---|
| 1,941,413 | A | * | 12/1933 | Paige | 242/118.6 |
| 2,048,995 | A | * | 7/1936 | Clinton | 242/125.1 |
| 4,106,711 | A | * | 8/1978 | Oswald et al. | 242/487.6 |
| 4,673,304 | A | | 6/1987 | Liu et al. | |
| 4,676,680 | A | * | 6/1987 | Hauger et al. | 400/211 |
| 4,697,756 | A | | 10/1987 | Kofler | |
| 5,174,667 | A | | 12/1992 | Sugimoto et al. | |
| 5,385,416 | A | | 1/1995 | Maekawa et al. | |
| 6,276,849 | B1 | | 8/2001 | Feitel et al. | |
| 6,425,548 | B2 | | 7/2002 | Christensen et al. | |
| 7,063,470 | B2 | | 6/2006 | Spurr et al. | |
| 2008/0180477 | A1 | | 7/2008 | Trombley | |

* cited by examiner

*Primary Examiner* — Sang Kim
(74) *Attorney, Agent, or Firm* — Ronald R. Schindler, II

(57) ABSTRACT

Web medium supplies for a printer that uses a web medium on a core and printers are provided. In one aspect, the web medium supply has a frame with a first mounting support and second mounting support that are positioned along an axis of rotation. A first core mounting supports the core for rotation around the axis of rotation and a second core mounting supports the core for rotation around the axis of rotation. Rotation of the core is controlled by a first force applied to the first core mounting and a second force applied to the second core mounting that are both less than a third force that is sufficient to drive an alternative core against an inertial load of the core and web from one driven end.

11 Claims, 32 Drawing Sheets

FRONT VIEW

TOP VIEW

FRONT VIEW

TOP VIEW

FRONT VIEW

TOP VIEW

PRINTER WEB MEDIUM SUPPLY WITH DRIVE SYSTEM

CROSS REFERENCE TO RELATED APPLICATIONS

This application relates to commonly assigned, U.S. application Ser. No. 13/015,606, filed Jan. 28, 2011, entitled: "METHOD FOR OPERATING PRINTER WEB MEDIUM SUPPLY"; U.S. application Ser. No. 13/015,607, filed Jan. 28, 2011, entitled: "PRINTER WEB MEDIUM SUPPLY"; U.S. application Ser. No. 13/015,611, filed Jan. 28, 2011, entitled: "CORE DRIVING METHOD FOR PRINTER WEB MEDIUM SUPPLY"; each of which is hereby incorporated by reference.

FIELD OF THE INVENTION

This invention pertains to the field of printing.

BACKGROUND OF THE INVENTION

It is well known to supply donor mediums and receiver mediums used in printers in the form continuous webs that are wound onto a core until used. This method of web medium storage is highly efficient allowing a large amount of web medium to be supplied to a printer in a form that is easy to manufacture and readily accessible for use during printing. Accordingly, printers are often designed with medium supplies that use core wound webs of medium.

Typically, the large amount of web medium that can be stored on a core has a high mass. This in turn requires that the core has a beam strength that is sufficient to support the mass of web medium when loaded in the printer and a yield strength along an axis of rotation that is sufficient to transfer any forces required to control rotation of the core and associated web medium. For these reasons the core itself can have a relatively high mass and thus the overall mass of a core and associated web can be significant.

The high mass of a core and associated web medium increases demands made upon the printer in applying forces to control rotation of the core and associated web. Specifically, it will be appreciated that controlled supply of a web medium from a core requires an ability to precisely accelerate and decelerate the core and associated web. The mass of the core and associated web creates significant inertial loads that must be overcome by the forces that create such acceleration and deceleration. Such inertial loads can be particularly high where the core and associated web medium are used in printers that draw web medium from the core at rates that compel high speed rotation of the core.

Accordingly, an interface between the core and a mounting that is rotated to apply forces to drive the core and associated mounting must be engaged to the core in a manner that is secure enough to keep the core from slipping relative to the mounting when such forces are applied. In some printers, the core and core mounting that drives the core will have mechanical features such as notches or grooves that extend longitudinally along the length of the core that can engage with protrusions provided by the mountings. These approaches help to provide such a secure engagement. One example of this is shown in U.S. Pat. No. 6,425,548, issued to Christensen et al. on Jul. 30, 2002 in which a core and hub assembly are provided for a printing device. This device provides keys that are mounted at a proximal end of a mount which serve to transmit torque when engaged with a codesigned core. It will be appreciated that this system requires the use of a complex core and a complex mounting.

What is also needed therefore are printers and web medium supplies for use in printers that can reliably apply forces that drive the core and web against a high inertial load, yet do not increase the complexity of core, mounting or the process of loading a core in a printer web medium supply.

It is also desirable to provide a designer of a printer with greater design freedom with respect to the size, weight complexity and expense of the core and associated web and to further have greater design freedom with respect to the size, weight, cost and performance capability of the printer. However, the mass of the core and associated web can reduce such freedom. Thus, what are also needed are web medium supplies and methods that allow greater design freedom despite the high mass and high inertial loads provided by the core and associated web.

It is also well known that each web medium used by a printer has characteristics that can influence the appearance of a print made using the web medium. Many existing reader systems are known that read markings on a core or that detect the presence of a radio frequency identification tag to allow automatic determination of data from which the characteristics of such a web can be determined. However, reader systems can be complex and expensive. Alternatively, less complex mechanical encodements such as notches in a core can be detected using less complex readers. However such encodements are vulnerable to damage. Thus what is also needed in the art are web medium supplies and methods that can automatically determine data regarding a web that is on a core using a less complex, less expensive, and more robust approach.

Further, it will be appreciated that as the mass of a core and associated web increases the demands made on an operator in mounting the core and associated web in a printer also increase. As an initial matter the high mass of the core and associated web can be difficult to lift. Further, the high mass of the core and associated web can make it difficult for an operator to adjust a velocity of the core and associated web as is required to position the core and associated web during loading. This is because the inertia of the core and associated web is high and therefore any attempt to accelerate or decelerate a core and associated web must be made against an inertial load. These difficulties can cause a user to drop or otherwise mis-handle a core when loading the core into a printer which can damage the core, the web medium or the printer.

In some instances, the process of loading a core and associated web into a printer is further complicated because the proper orientation of a core within a pair of mountings that hold the core for rotation in a printer may not be apparent. Mis-assembly of the core to mountings that hold the core for rotation can interrupt or undermine the printing process for example, by causing images to be printed on the wrong side of a receiver medium.

What is further needed therefore are web medium supplies and methods that reduces the risk that a core and associated web will be mis-loaded or mis-assembled without making loading more difficult.

SUMMARY OF THE INVENTION

Web medium supplies and printers are provided. In one aspect, a web medium supply for a web medium on a core is provided with the web medium supply having a frame having a first mounting support and second mounting support that are positioned along an axis of rotation and separated by a separation distance during the supply of the web, a first core mounting having a first surface that is rotatably supportable by the first mounting support about the axis of rotation and a first engagement end to which a first end of a core can be mounted and a first engagement surface through which a first force urging the core to rotate can be transmitted to the core to urge the core to rotate with the first mounting; and a second core mounting having a second surface that is rotatably supportable by the second mounting support about the axis of rotation and a second engagement end to which a second end of the core can be mounted and a second engagement surface through which a second force urging the second core to rotate can be transmitted to the core to urge the core to rotate with the second mounting. A drive transmission has an input end to receive an input force, a first output mechanically linked for movement with the first core mounting and a second output mechanically linked for movement with the second core mounting with the drive transmission mechanically linking the input end to the first output and to second output and distributing an amount of force supplied at the input end between the first force and the second force such that the first force and second force can, in combination, rotate the first core mounting, second core mounting, core and any web wound thereon against an inertial load of the core and web. Both the first force and the second force are less than a third force that is sufficient to drive an alternative core against the inertial load from one driven end and wherein the core has a first yield strength at the first end and a second yield strength at the second end that are each less than a third yield strength that is required to receive the third force at the driven end of the alternative core.

In another aspect, a web medium supply is provided with a frame having a first mounting support and second mounting support that are positioned along an axis of rotation and separated by a separation distance during the supply of web medium, a first core mounting having a first surface that is rotatably supportable by the first mounting about the axis of rotation and a first engagement end to which a first end of a core can be mounted and a first engagement surface through which a first force urging the core to rotate can be transmitted to the first end of the core to urge the core to rotate with the first core mounting and a second core mounting having a second surface that is rotatably supportable by the second mounting about the axis of rotation; and a second engagement end to which a second end of the core can be mounted and a second engagement surface through which a second force urging the core to rotate can be transmitted to the second end of the core to urge the core to rotate with the second core mounting. A first actuator drives the first core mounting to rotate about the axis of rotation; and a second actuator drives the second core mounting to rotate about the axis of rotation. A first sensor senses a condition from which a rotational position of the first end of the core can be determined and generating a first sensor signal from which the rotational position of the first end of the core can be determined; and a second sensor senses a condition from which a rotational position of a second end of the core can be determined and generating a second sensor signal from which the rotational position of the second end of the core can be determined. A controller receives the first sensor signal and the second sensor signal and generates a first control signal causing the first actuator to operate so that a first force is applied to the first end of the core and generating a second control signal causing the second actuator to operate so that a second force is applied to the second end of the core together control rotation of the core against an inertial load provided by the core and any web medium wound thereon. The controller causes both the first force and the second force to be less than a third force that is sufficient to drive an alternative core against the inertial load from one driven end and wherein the core has a first yield strength at the first end and a second yield strength at the second end that are each less than a third yield strength that is required to receive the third force at the driven end of the alternative core.

In another aspect, a printer is provided that uses a web medium on a core. In this aspect, the printer has a print engine that uses the web to form an image, a web transport having a movable surface convey the web to the print engine for printing, and a frame having a first mounting support and second mounting support that are positioned along an axis of rotation and separated by a separation distance during the supply of web medium. A first core mounting has a first surface that is rotatably supportable by the first mounting about the axis of rotation and a first engagement end to which a first end of a core can be mounted and a first engagement surface through which a first force urging the core to rotate can be transmitted to the first end of the core to urge the core to rotate with the first core mounting and a second core mounting has a second surface that is rotatably supportable by the second mounting about the axis of rotation; and a second engagement end to which a second end of the core can be mounted and a second engagement surface through which a second force urging the core to rotate can be transmitted to the second end of the core to urge the core to rotate with the second core mounting.

A first actuator drives the first core mounting to rotate about the axis of rotation and a second actuator drives the second core mounting to rotate about the axis of rotation. A first sensor senses a condition from which a rotational position of the first end of the core can be determined and generating a first sensor signal from which the rotational position of the first end of the core can be determined; and a second sensor senses a condition from which a rotational position of a second end of the core can be determined and generating a second sensor signal from which the rotational position of the second end of the core can be determined. A controller receives the first sensor signal and the second sensor signal and generating a first control signal causing the first actuator to operate so that a first force is applied to the first end of the core and generating a second control signal causing the second actuator to operate so that a second force is applied to the second end of the core together to rotate the core against an inertial load provided by the core and any web medium wound thereon. The controller causes both the first force and the second force to be less than a third force that is sufficient to drive an alternative core against the drag from one driven end and wherein the core has a first yield strength at the first end and a second yield strength at the second end that are each less than a third yield strength that is required to receive the third force at the driven end of the alternative core.

DETAILED DESCRIPTION OF THE DRAWINGS

DETAILED DESCRIPTION OF THE INVENTION

Figure 1:
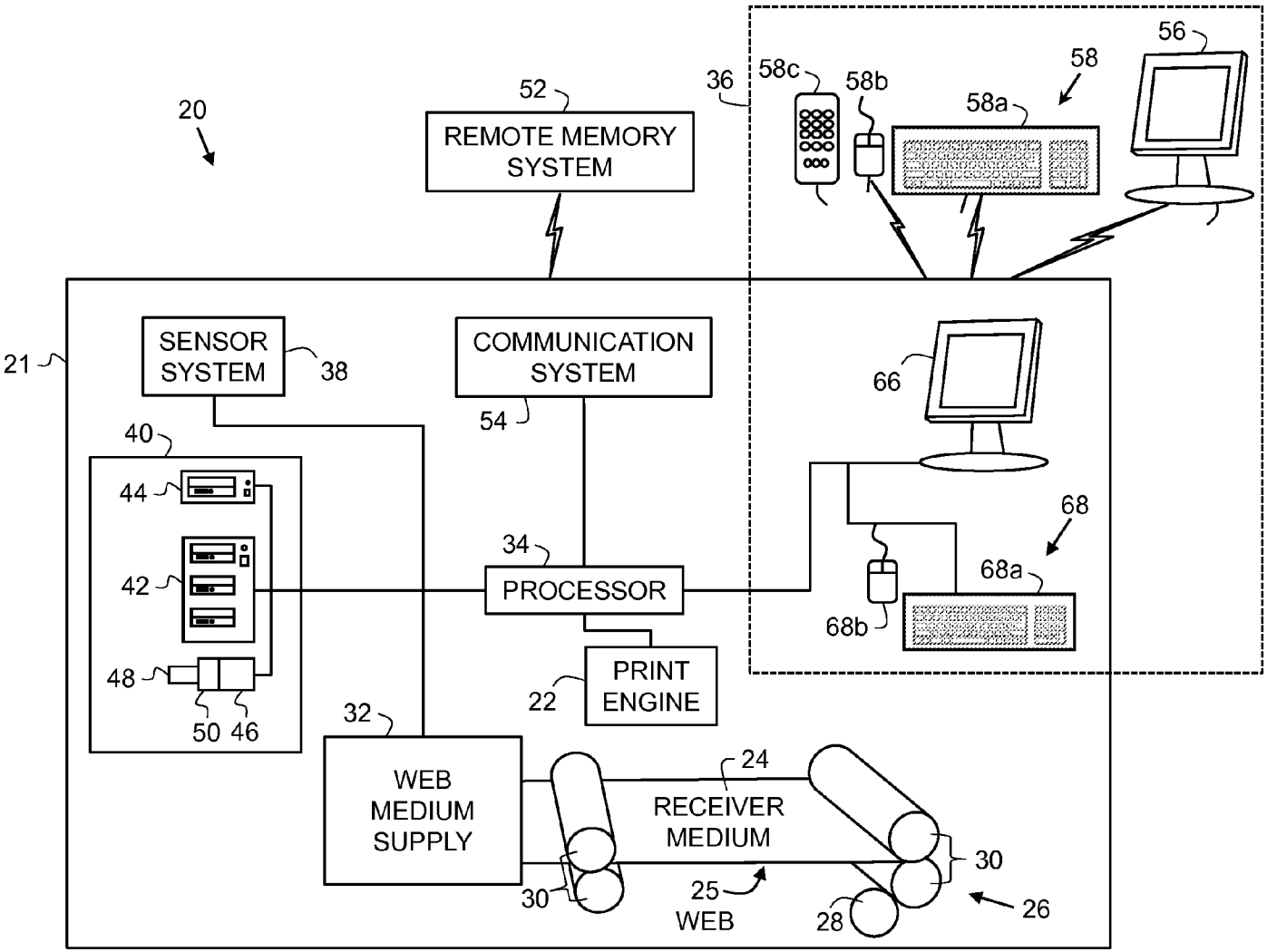
FIG. 1 shows one embodiment of a printer having a web supply.

FIG. 1 shows one embodiment of a printer 20. In the embodiment of FIG. 1, printer 20 comprises a housing 21 having a print engine 22 that applies markings or otherwise forms an image on a receiver medium 24. Print engine 22 can record images on receiver medium 24 using a variety of known technologies including, but not limited to, conventional four color offset separation printing or other contact printing, silk screening, dry electrophotography such as is used in the NexPress 2500 printer sold by Eastman Kodak Company, Rochester, N.Y., USA, thermal printing technology, drop on demand ink jet technology and continuous inkjet technology. For the purpose of the following discussions, print engine 22 will be described as being of a type that generates color images. However, it will be appreciated that this is not necessary and that the claimed methods and apparatuses described and claimed herein can be practiced with a print engine 22 that prints monotone images such as black and white, grayscale or sepia toned images or that prints functional materials such as electronic, biological or optical materials or component thereof.

A medium advance 26 is used to position receiver medium 24 relative to engine 22. Medium advance 26 can comprise, for example, any number of well-known systems for moving receiver medium 24 within printer 20, including a motor 28 driving pinch rollers 30, a motorized platen roller (not shown) or other well-known systems for the movement of paper or other types of receiver medium 24.

Web medium supply 32 supplies a web 25 of a medium used by printer 20 during printing. As is shown in FIG. 1, web 25 can comprise a receiver medium 24 on which an image is formed. Examples of receiver medium 24 include paper, films, fabrics, or any other substrate that can be used to provide an image including but not limited webs of material that are sensitized with materials that react to print engine 22 to form images. Web 25 can also comprise a donor medium that bears materials that can be used by print engine 22 or other components of printer 20 during printing. Examples of donor mediums include thermal mass transfer donor webs 25 that convey, for example, dyes, pigments, clear or opaque coatings, protective materials, materials that can be used for authenticity, metals or functional materials that can be transferred using for example heat and pressure applied by a thermal type print engine 22, other print engine type or other systems in printer 20. Although the following discussion of printer 20 will illustrate examples of web medium supply 32 delivering a single web 25, it will be appreciated that this is done for convenience only and that web medium supply 32 can have a plurality of such systems that operate in parallel to deliver more than one web 25 such as where a thermal print engine 22 requires both a donor web 25 and a receiver web 25 or in any other situation where any type of print engine 22 has need of multiple webs 25 of medium to print.

A processor 34 operates print engine 22, medium advance 26, web medium supply 32 and other components of printer 20 described herein. Processor 34 can include, but is not limited to, a programmable digital computer, a programmable microprocessor, a programmable logic processor, a series of electronic circuits, a series of electronic circuits reduced to the form of an integrated circuit, or a series of discrete components. Processor 34 operates printer 20 based upon input signals from a user input system 36, sensor system 38, a memory 40 and a communication system 54. Processor 34 can be a unitary device or it can comprise any of a combination of various components some of which may be within housing 21 and others of which may be external thereto.

User input system 36 can comprise any form of transducer or other device capable of receiving an input from a user and converting this input into a form that can be used by processor 34. For example, user input system 36 can comprise a touch screen input, a touch pad input, a 4-way switch, a 6-way switch, an 8-way switch, a stylus system, a trackball system, a joystick system, a voice recognition system, a gesture recognition system, a keyboard, a remote control or other such systems. In the embodiment shown in FIG. 1, user input system 36 includes an optional remote input 58 and a local input 68.

Sensor system 38 can include light sensors such as photocells and imagers, contact sensors and related sensing structures to actuate the contact sensors, proximity sensors of Hall effect sensors, and or any other sensors known in the art that can be used to detect conditions in the environment proximate to or within printer 20 and any circuits or systems that can generate signals indicative of the detected condition to convert this information into a form that can be used by processor 34 in governing operation of print engine 22 and/or other systems of printer 20. Sensor system 38 can include audio sensors adapted to capture sounds. Sensor system 38 can also include positioning and other sensors used internally to monitor printer operations.

Memory 40 can include conventional memory devices including solid state, magnetic, optical or other data storage devices. Memory 40 can be fixed within printer 20 or it can be removable. In the embodiment of FIG. 1, printer 20 is shown having a hard drive 42, a disk drive 44 for a removable disk such as an optical, magnetic or other disk memory (not shown) and a memory card slot 46 that holds a removable memory 48 such as a removable memory card and has a removable memory interface 50 for communicating with removable memory 48. Data including but not limited to control programs, digital images and metadata can also be stored in a remote memory system 52 that is external to printer 20 such as a personal computer, computer network or other digital system.

In the embodiment shown in FIG. 1, printer 20 has a communication system 54 that is optionally used in this embodiment to communicate with remote memory system 52, remote display 56, and remote input 58. Remote input 58 can take a variety of forms, including but not limited to, the remote keyboard 58*a*, remote mouse 58*b* or remote control handheld device 58*c* illustrated in FIG. 1. Remote display 56 and/or remote input 58 can communicate with communication system 54 wirelessly as illustrated or can communicate in a wired fashion.

Similarly, local input 68 can take a variety of forms. In the embodiment of FIG. 1, local input 68 is shown that includes a local keyboard 68*a* and a local mouse 68*b*. Further, in the embodiment of FIG. 1, local display 66 and local input 68 are shown being within housing 21 and directly connected to processor 34. In alternative embodiments, either or both of local display 66 and local input 68 can be connected to processor 34 by way of a wired or wireless connection with communication system 54 and can be positioned outside of housing 21.

Communication system 54 can comprise for example, one or more optical, radio frequency, or other transducer circuits or other systems that convert image and other data into a form that can be conveyed to a remote device such as remote memory system 52 or remote display 56 using an optical signal, radio frequency signal or other form of signal. Communication system 54 can also be used to receive a digital image and other data from a host computer or network (not shown), remote memory system 52 or remote input 58. Communication system 54 provides processor 34 with information and instructions from signals received thereby.

Typically, communication system 54 will have circuits and systems that communicate with other devices including a host computer or network (not shown), remote memory system 52, a remote input 58 by way a communication network such as a conventional telecommunication or data transfer network such as the internet, a cellular, peer-to-peer or other form of mobile telecommunication network, a local communication network such as wired or wireless local area network or any other conventional wired or wireless data transfer system. In this regard communication system 54 can use any conventional communication circuits or components.

In operation, printing instructions are received from local input 68 or from communication system 54 causing a receiver medium 24 to be loaded from web medium supply 32 and causing print engine 22 and medium advance 26 to cooperate to cause a desired image to be printed. These steps can be performed in a conventional fashion.

Printer Medium Supply

Figure 2:
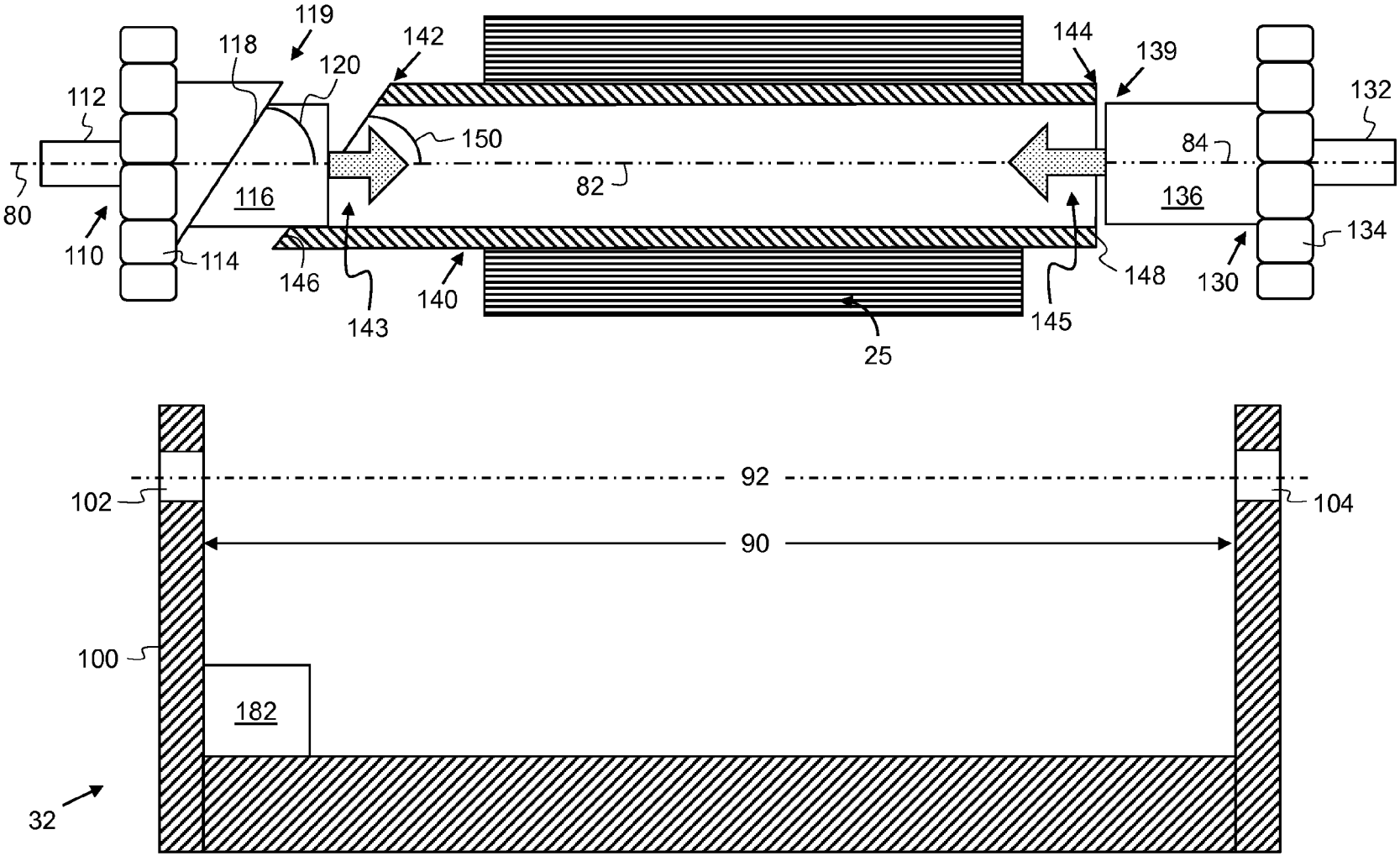
FIG. 2 shows a first embodiment of a web supply having mountings and a core that is used in the web supply.

FIG. 2 shows a first embodiment of a web medium supply 32 for printer 20. As is shown in FIG. 2, web medium supply 32 has a web supply frame 100 positioning a first mounting support 102 at a separation distance 90 from a second mounting support 104 along or parallel to an axis of rotation 92.

A first core mounting 110 is provided having a first surface 112 that is rotatably supportable by the first mounting support 102 and a first engagement end 119 to support a first end 142 of a core 140. A second core mounting 130 is also provided having a second surface 132 that is rotatably supportable by the second mounting 104 and a second engagement end 139 to support a second end 144 of core 140.

Core 140 has a first open area 143 beginning at first end 142 and extending toward second end 144 and a second open area 145 beginning at second end 144 and extending toward first end 142. First open area 143 and second open area 145 are shaped to receive first engagement end 119 and second engagement end 139.

In this embodiment, first surface 112 has a cylindrical shape allowing first core mounting 110 to rotate about an axis of rotation 80. Similarly, second surface 132 has a cylindrical shape allowing second core mounting 130 to rotate about an axis of rotation 84. Other shapes and mounting arrangements can be used for first surface 112, second surface 132, first mounting support 102 and second mounting support 104 that enable rotation consistent with what is described herein.

In the embodiment of FIG. 2, first core mounting 110 and second core mounting 130 are shown taking the form of gudgeons that are separable from web medium supply 32. Accordingly, first core mounting 110 and second core mounting 130 can be assembled to a core 140 outside of the confines of web medium supply 32 or frame 100 where there is typically more room to manipulate first core mounting 110, second core mounting 130 and core 140.

First engagement end 119 of first core mounting 110 has a first core support surface 116 shaped for insertion into first open area 143 at first end 142 of core 140 while second core mounting 130 has a second engagement end 139 with a second core support surface 136 shaped for insertion into second open area 145 of core 140. First core support surface 116 and second core support surface 136 extend, respectively, into first open area 143 and second open area 145 of core 140 to an extent that supports the weight of core 140 and any web 25 wound thereon and that allows core 140 to rotate about axis of rotation 92 when first surface 112 is supported by first mounting support 102 and when the second surface 132 is supported by second mounting support 104.

Figure 3:
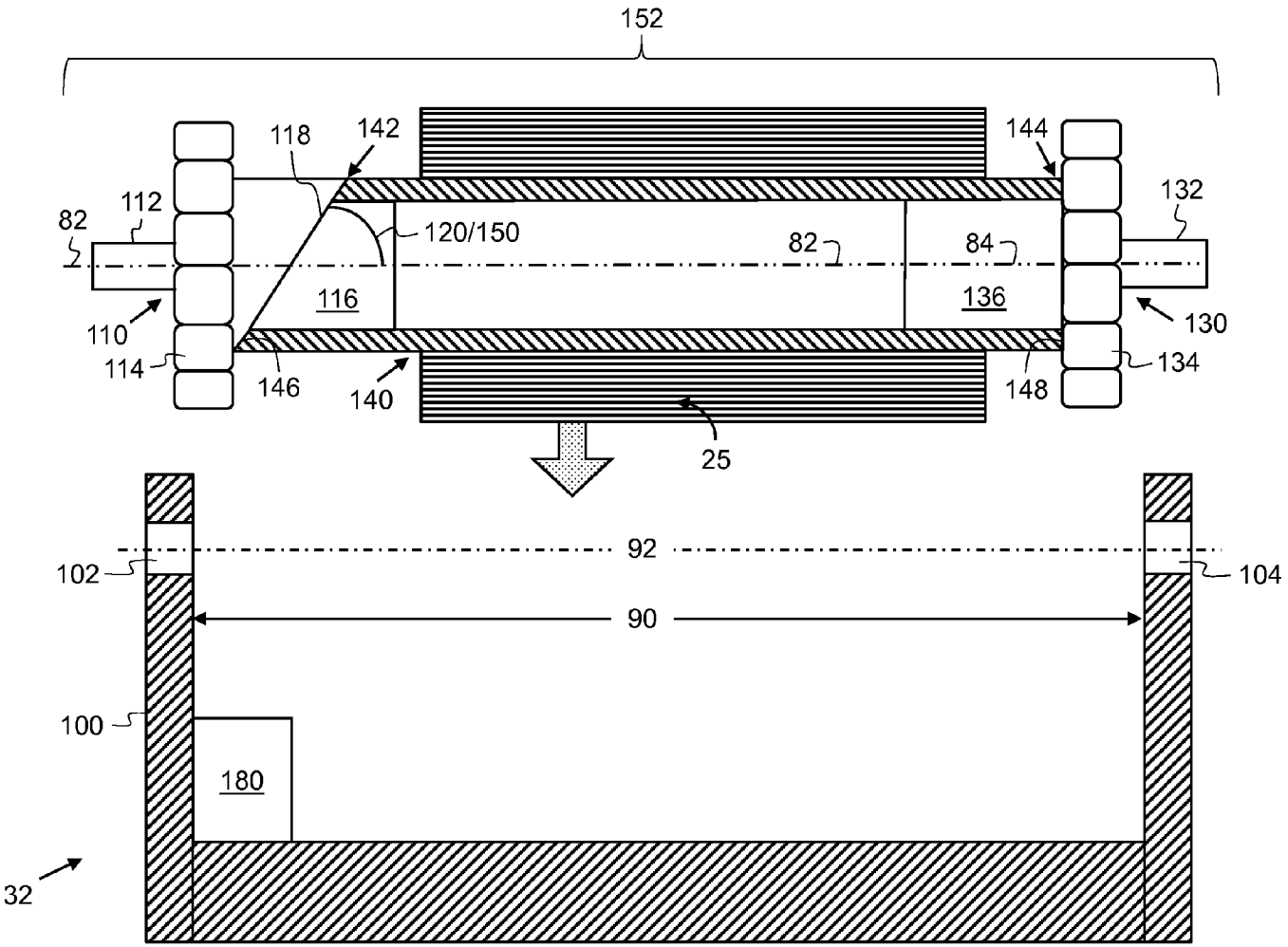
FIG. 3 illustrates the embodiment of FIG. 2 showing the core and mountings assembled.
Figure 4:
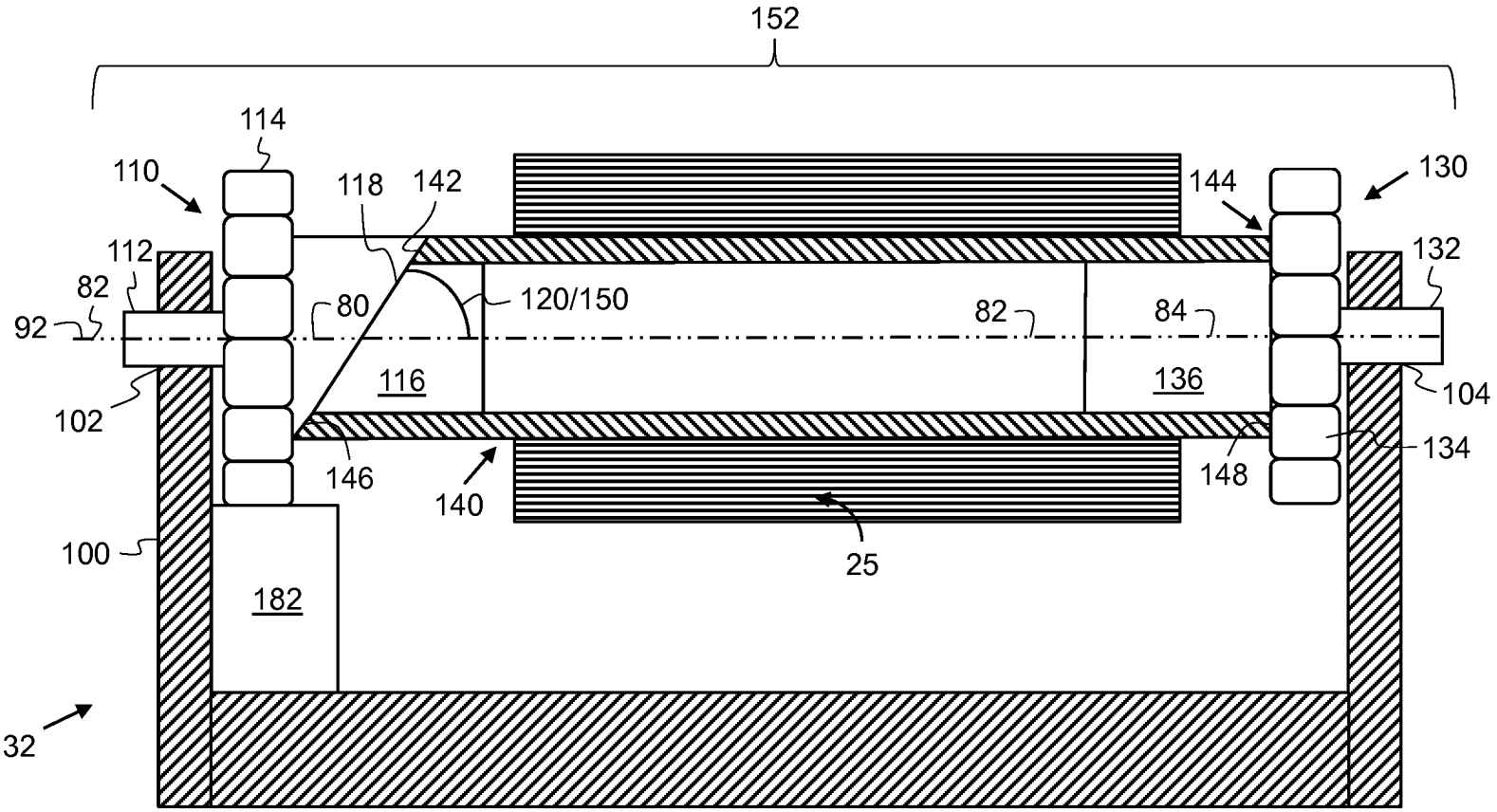
FIG. 4 shows the embodiment of FIGS. 2 and 3 with the assembled core and mountings mounted in the web supply.

As is shown in FIG. 3, when first core mounting 110 and second core mounting 130 are joined to a core 140 they form a core/mounting assembly 152. As is shown in FIG. 4, core/mounting assembly 152 can be placed into frame 100 by positioning the core/mounting assembly 152 so that first surface 112 and second surface 132 are inserted into first mounting support 102 and second mounting support 104. As is shown here, an optional actuator 182 is provided that can engage a first drive surface 114 of first core mounting 110 or in an alternative embodiment a second drive surface 134 of second core mounting 130 to drive core/mounting assembly 152 to rotate.

As is also shown in FIG. 2, first core mounting 110 further has an first engagement surface 118 proximate first engagement end 119 that is at a first engagement angle 120 that is not perpendicular to an axis of rotation 80 of first core mounting 110. As is shown here first engagement surface 118 takes or generally follows the form of a planar section of a hollow cylinder taken at first engagement angle 120 relative to the axis of rotation 82 of core 140. Similarly, first end 142 of core 140 has a first engaged surface 146 that is at a first engaged angle 150 relative to an axis of rotation 82 of core 140. First engaged surface 146 likewise takes or generally follows the form of a planar section of core 140.

When first end 142 of core 140 is mounted to first core mounting 110, and second end 144 of core 140 is mounted to second core mounting 130 axis of rotation 80 of first core mounting 110 and axis of rotation 82 of core 140 are aligned with an axis of rotation 84 of second core mounting 130. When first core mounting 110 and second core mounting 130 are installed on first mounting support 102 and second mounting support 104 and the angular relationship between first engagement angle 120 and the first engaged angle 150 correspond, axes 80, 82 and 84 are collectively aligned with axis of rotation 92.

The extent to which first core support surface 116 can be inserted into first open area 143 of core 140 is determined by the correspondence between first engagement angle 120 and first engaged angle 150. Accordingly, when first engagement angle 120 and first engaged angle 150 correspond, first core support surface 116 can be inserted into first end 142 of core 140 to an extent that supports first end 142 of core 140 and any web 25 stored thereon and allows core/mounting assembly 152 to fit in the separation distance 90 between first mounting support 102 and second mounting support 104 such that core/mounting assembly 152 can rotate about axis of rotation 92.

However, when first engagement angle 120 and first engaged angle 150 do not correspond, first core mounting 110 and second core mounting 130 do not support core 140 for rotation about axis of rotation 92. This can occur, for example, because the first core mounting 110 cannot be inserted into core 140 to an extent that is sufficient to create a core/mounting assembly 152 having a length that is within separation distance 90 or because first core mounting 110 cannot be inserted into core 140 to an extent that is sufficient to form a core/mounting assembly 152 that can support the load of core 140 and associated web 25 in a manner that can be rotated about axis of rotation 92.

These outcomes provide a clear indication that a particular combination of a first core mounting 110, second core mounting 130 and core 140 is not correct as will be shown in the following examples of various incorrect combinations of a core 140 with a first core mounting 110 and a second core mounting 130.

Figure 5:
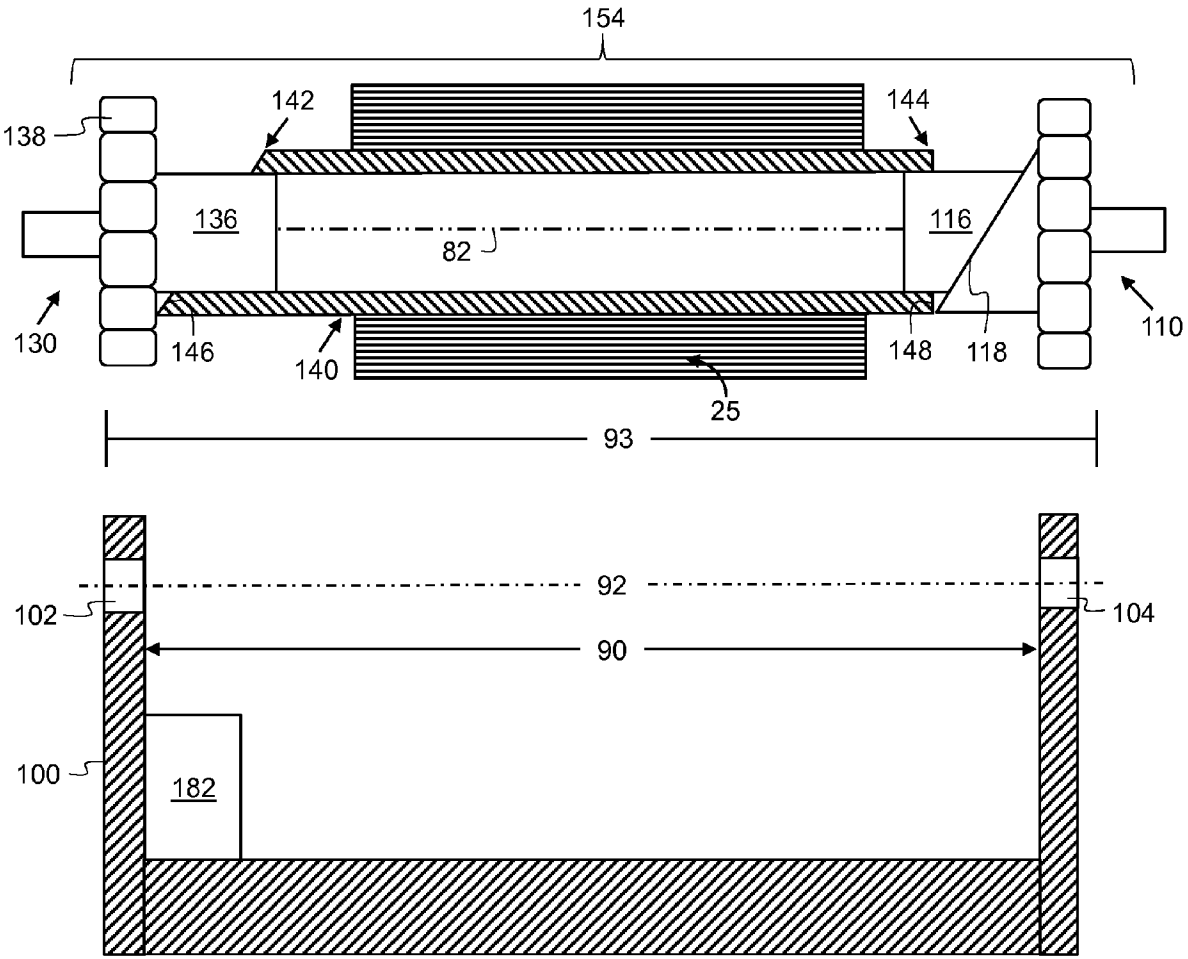
FIG. 5 illustrates the embodiment of web supply of FIGS. 2-4 and where the core assembled with mountings at wrong ends of the core.

In one example shown in FIG. 5, a common loading error is illustrated that arises when second end 144 of core 140 is assembled to first core mounting 110 and when a first end 142 of core 140 is assembled to second core mounting 130. As is shown in FIG. 5, second core mounting 130 has a second core support surface 136 with a second engagement surface 138 that is essentially perpendicular to the axis of rotation 82 of core 140 and which contacts first engaged surface 146 at a position that defines one end of a separation distance 93 while first engagement surface 118 of first core mounting 110 engages second engaged surface 148 to define a second end of separation distance 93. The mis-assembled core/mounting assembly 154 requires separation distance 93 that is greater than separation distance 90. Accordingly, such a mis-assembled core/mounting assembly 154 cannot be loaded into frame 100 and therefore cannot be supported by first mounting support 102 and second mounting support 104 of frame 100 for rotation about an axis of rotation 92. This inability to mount core/mounting assembly 154 provides a clear indication that something is incorrect with the assembly and further prevents any attempt to use of core/mounting assembly 154.

Figure 6:
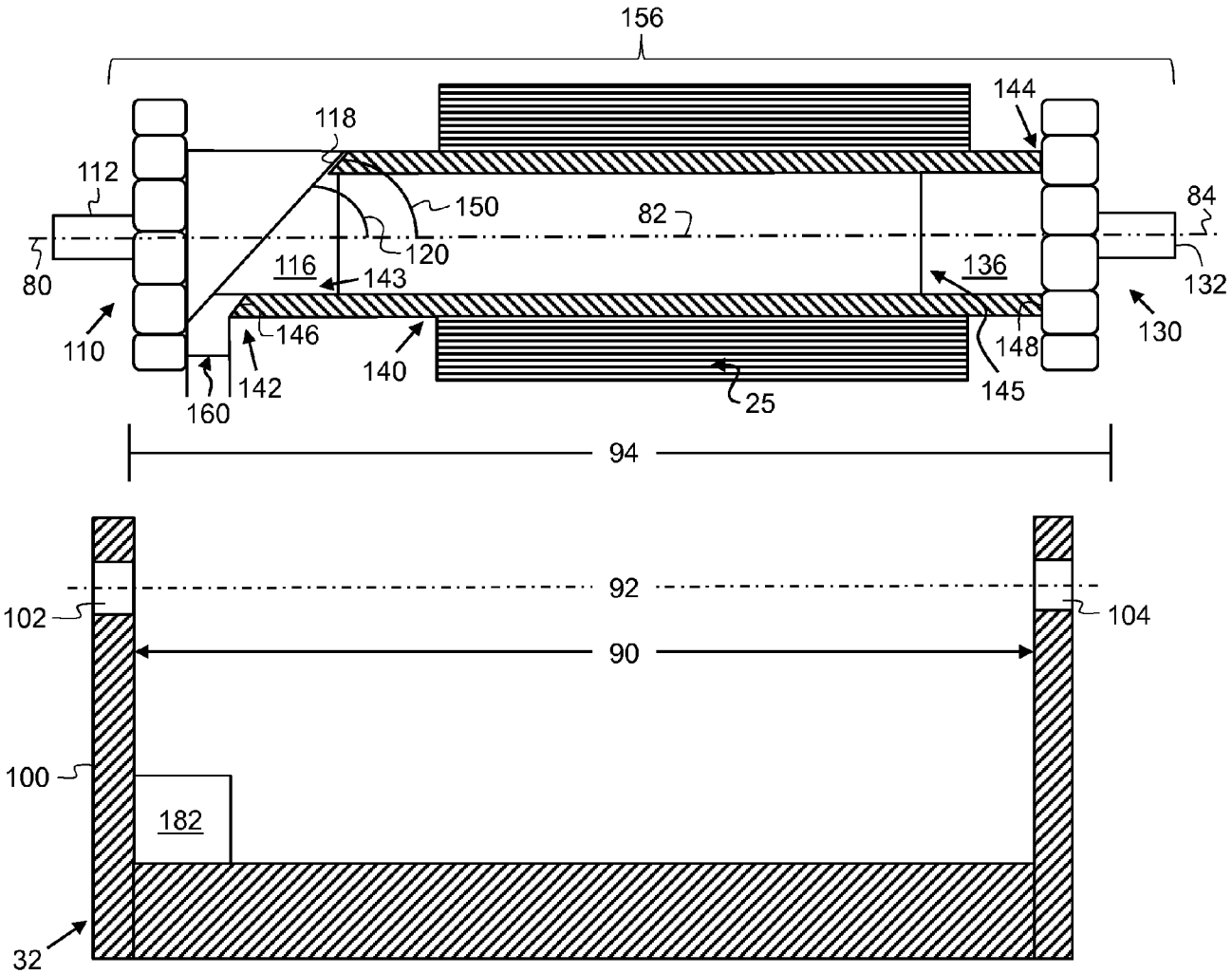
FIG. 6 illustrates the embodiment of FIGS. 2-4 where the core has an engaged angle that corresponds to an engagement angle of the first core mounting.
Figure 7:
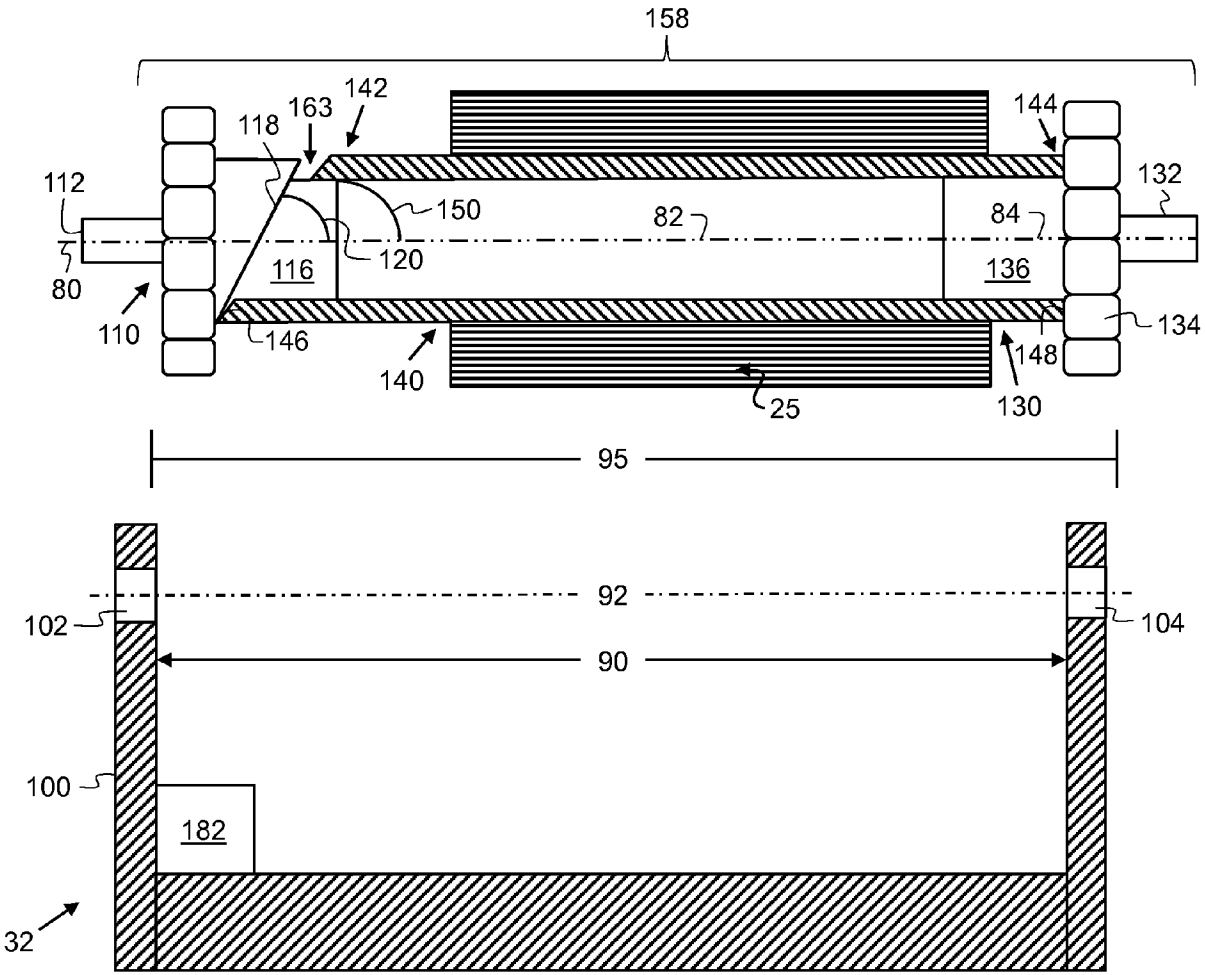
FIG. 7 illustrates the embodiment of FIGS. 2-4 where the core has an engaged angle that does not correspond to an engagement angle of the first core mounting.
Figure 8:
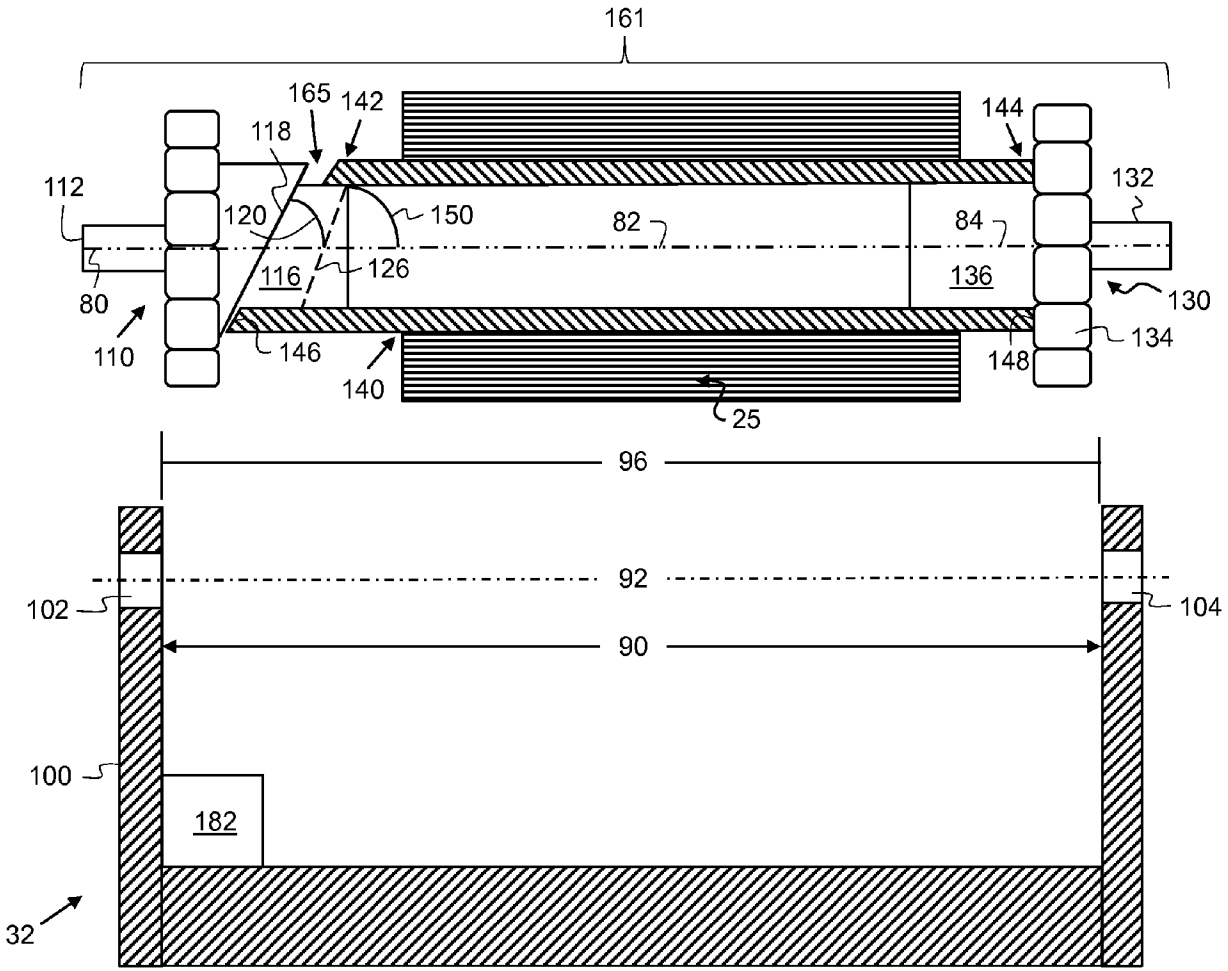
FIG. 8 illustrates the embodiment of FIGS. 2-4 where the core has an engaged angle that does not correspond to the engagement angle of the first core mounting.

In other examples shown in FIGS. 6, 7 and 8, a core 140 has a first end 142 with a first engaged surface 146 having a first engaged angle 150 that does not correspond with a first engagement angle 120 of a first engagement surface 118. This can occur in a variety of circumstances, including, but not limited to, situations where, for example, core 140 being inserted into web medium supply 32 has a web 25 that is not intended for use with printer 20 or that is not of a type (e.g. donor or receiver type) that is consistent with a type of web 25 that is to be loaded on first core mounting 110 and second core mounting 130 in web medium supply 32, or where, for other reasons first core mounting 110 or second core mounting 130 are not intended for use with web medium supply 32 or for use with core 140, such as where first core mounting 110 or second core mounting 130 are designed for use in a different printer or in any other situation where the combination of a particular first core mounting 110 or second core mounting 130 with core 140 is unintended, inappropriate, or incorrect.

In the example of FIG. 6 a mis-assembled core/mounting assembly 156 is created having a first core mounting 110 at a first engagement surface 118 with a first engagement angle 120 that is less than a first engaged angle 150 of a core 140. As is illustrated in FIG. 6, the extent to which first core support surface 116 of first core mounting 110 can be inserted into first end 142 of core 140 is limited to the extent of insertion provided when first engagement surface 118 contacts first engaged surface 146. Accordingly, first core support surface 116 of first core mounting 110 does not fully extend into first end 142 of core 140 and there is a separation 160 between first engagement surface 118 and a first engaged surface 146 opposite the point of contact. This causes the core/mounting assembly 156 illustrated in FIG. 6 requires a separation distance 94 that is greater than separation distance 90 thus preventing a mis-assembled core/mounting assembly 156 from being positioned for rotation within frame 100 of web medium supply 32.

In another example illustrated in FIG. 7, a mis-assembled core/mounting assembly 158 is shown with a core 140 that has a first engaged surface 146 that is at a first engaged angle 150 that is greater than a first engagement angle 120. As is illustrated in FIG. 7, the extent to which first core support surface 116 of first core mounting 110 can be inserted into first end 142 of core 140 is limited to the extent of insertion provided when first engagement surface 118 contact first engaged surface 146. Accordingly, first core mounting 110 does not extent into first end 142 to an intended extent and there is a separation 163 between first engagement surface 118 and a first engaged surface 146 opposite from a point of contact. This causes the mis-assembled core/mounting assembly 158 illustrated in FIG. 7 to require a separation distance 95 that is greater than the separation distance 90 in frame 100. This prevents mis-assembled core/mounting assembly 158 from being positioned within web supply frame 100 for rotation around axis of rotation 92 and provides a clear indication that an incorrect combination has been used.

In the example illustrated in FIG. 8, a mis-assembled core/mounting assembly 161 has a core 140 with a first engaged surface 146 that is at a first engaged angle 150 that is greater than first engagement angle 120 of first engagement surface 118 while still allowing first core mounting 110 to be mounted to core 140 to such that core/mounting assembly 161 has length 96 that is within the separation distance 90 despite the presence of a first engaged angle 150 that does not correspond to first engagement angle 120. This is possible, for example, if core 140 is shortened relative to a length of core 140 shown for example in FIGS. 5 and 6. Here first core support surface 116 can be inserted into core 140 to an extent that is less than the extent provided when the first engagement angle 120 corresponds to the first engaged angle 150 and creates a separation 163. This limits the amount of support that can be provided by first core mounting 140 and these limits can cause separation of first core mounting 110 from core 140 or that can introduce significant wobble or other rotation that is not aligned with the axis of rotation 92. Such conditions also serve notice to an operator that core/mounting assembly 161 is not correct. Optionally as is shown in FIG. 8, first core mounting 110 can have a tapered end cap 126 on first core support surface 116 that is angled to increase the likelihood that insufficient engagement will cause such separation or introduce such wobble.

It will be appreciated from the examples of FIGS. 5-8 that the web medium supply 32 is capable of providing a clear indication when a combination of a first core mounting 110, second core mounting 130 and a core 140 is incorrect.

The foregoing embodiments have been described using embodiments of web medium supply 32 having a first core mounting 110 and a second core mounting 130 that are separable from frame 100. This is not limiting. As will now be described with respect to FIGS. 9-11, in other embodiments, web medium supply 32 can have first core mounting 110 and second core mounting 130 fixed to first mounting support 102 and second mounting 104, respectively, such that core 140 and associated web 25 are mounted to first mounting support 102 and second mounting support 104 within frame 100.

Figure 9:
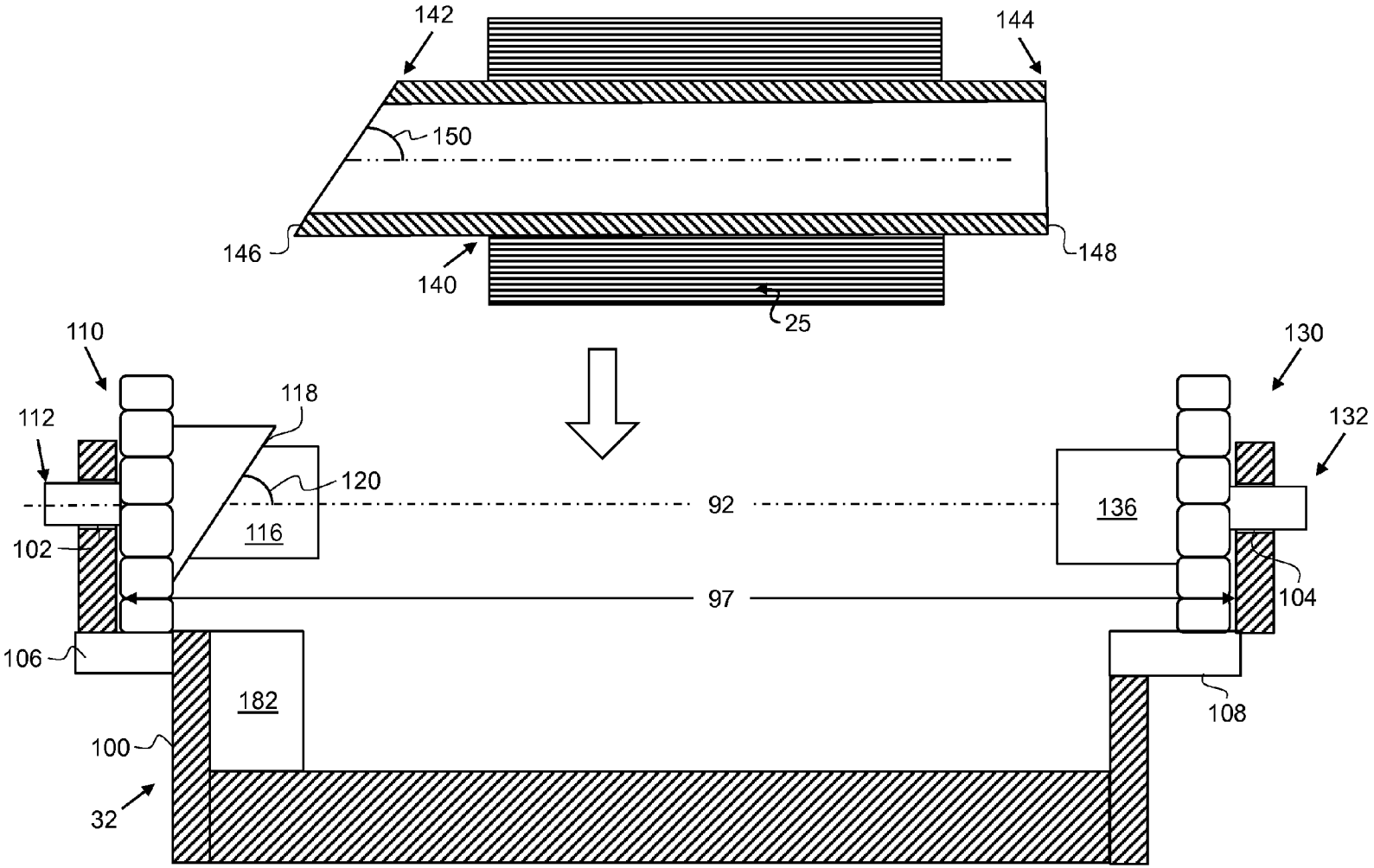
FIG. 9 illustrates another embodiment of a web supply system having core mounting supports that are joined to the frame and positioned at a loading position.
Figure 10:
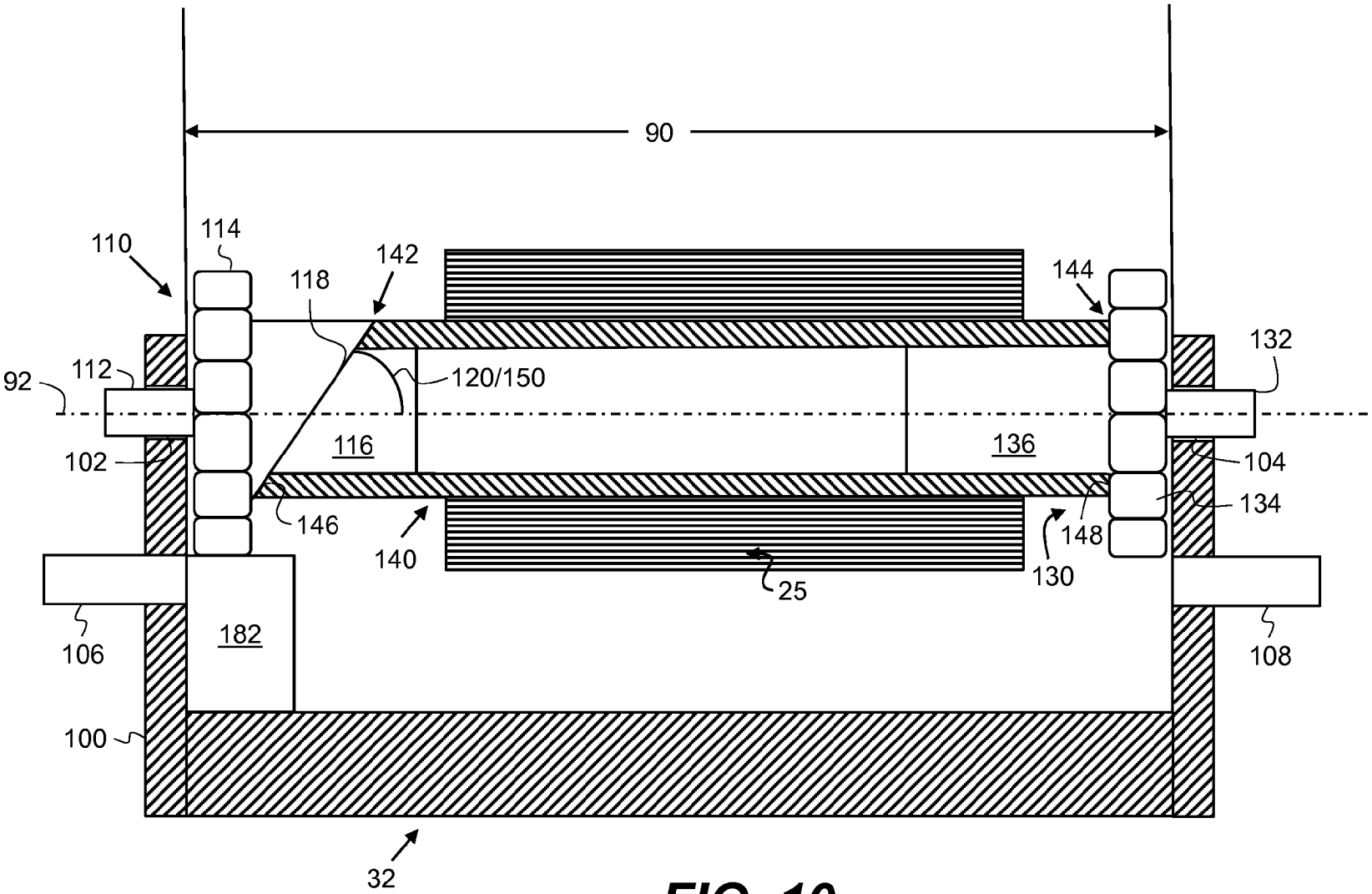
FIG. 10 illustrates the embodiment of web supply system of FIG. 9 in a loaded position.
Figure 11:
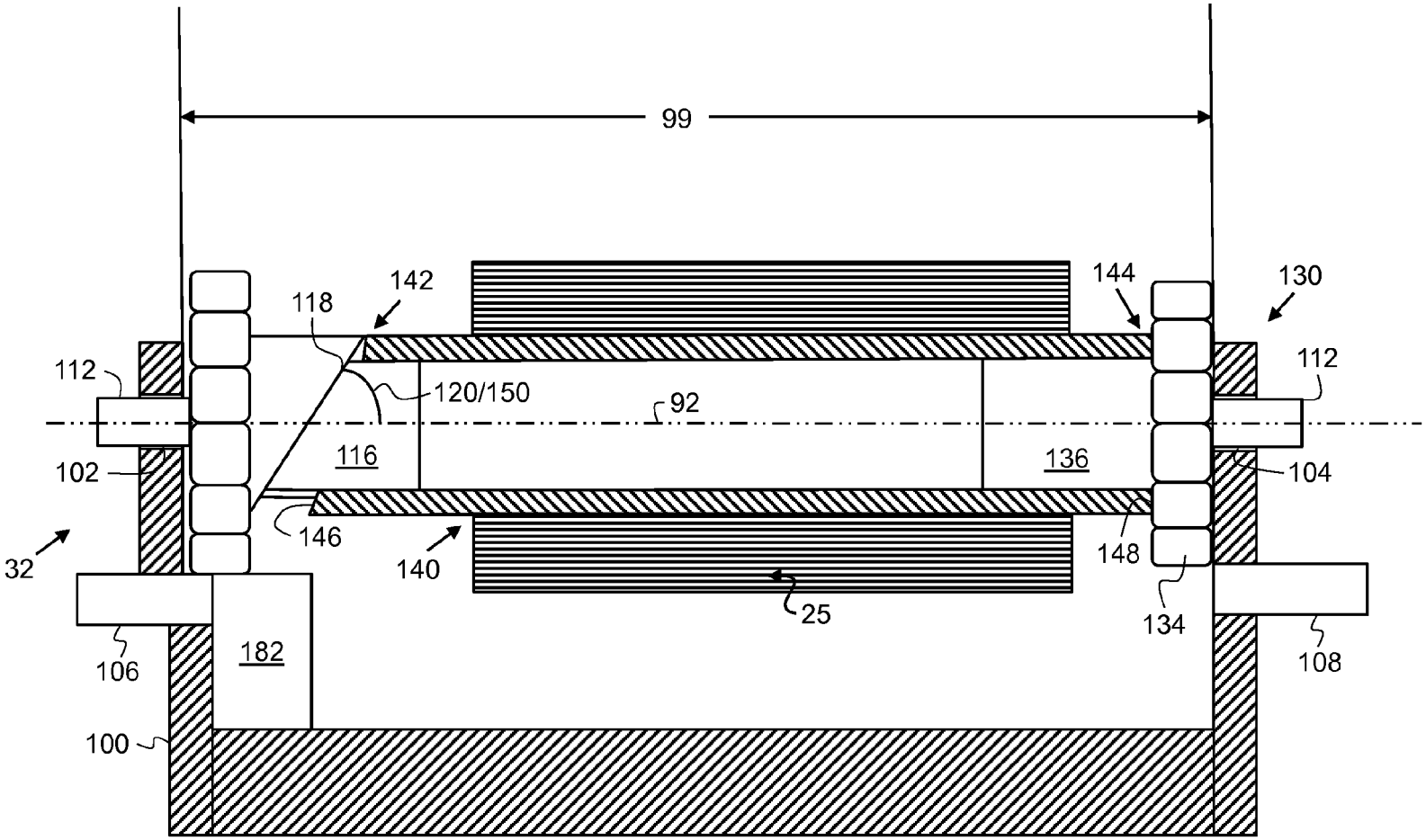
FIG. 11 illustrates the embodiment of FIG. 10 where a core is mounted that has an engaged surface with an engaged angle that does not correspond to engagement angles of core mounting.

In this embodiment of FIGS. 9, 10 and 11, first surface 112 of first core mounting 110 and second surface 132 second core mounting 130 are fixed to first mounting support 102 and second mounting support 104. As is shown in FIGS. 9 and 10, when first mounting support 102 and second mounting support 104 are separated by loading separation 97 a core 140 can be positioned between first core mounting 110 and second core mounting 130, and then first mounting support 102 and second mounting support 104 can be moved along tracks 106 and 108 toward a position where the first core mounting 110 and second core mounting 130 engage core 140 and are separated by the separation distance 90. In alternative embodiments, frame 100 can allow movement of first mounting support 102 or second mounting support 104 in other ways including but not limited to movement along a pivotal path.

Where, as shown in FIG. 10, first core mounting 110 has an first engagement surface 118 that is at a first engagement angle 120 that corresponds to a first engaged angle 150 of a first engaged surface 146 of core 140, first core mounting 110 and second core mounting 130 can be moved to a position where first core mounting 110 and second core mounting 130 support core 140 and web 25 associated with core 140 for rotation about axis of rotation 92.

However, as is shown in FIG. 11 where first core mounting 110 has a first engagement surface 118 that is at a first engagement angle 120 that does not correspond to the first engaged angle 150 of a first engaged surface of core 140, core 140 can prevent first mounting 110 and second mounting 130 from moving to a position that is separated by separation distance 90. This prevents first core mounting 110 and second core mounting 130 from engaging core 140 to an extent that is sufficient to support core 140 and associated web 25 for rotation about axis of rotation 92.

In this embodiment, this lack of support can stem from a failure of first core mounting 102 and second core mounting 104 to reach a position where first core mounting 102 and second core mounting 104 can be held in place along tracks 106 and 108 or because, even if held in this position, first core mounting 100 and second core mounting 130 do not provide sufficient support to enable core 140 to rotate about axis of rotation 92 and to permit core 140 to rotate around axes other than axis of rotation 92. Accordingly, this approach also provides a clear indication that a combination of first core mounting 110, second core mounting 130 and core 140 is incorrect.

Figure 12:
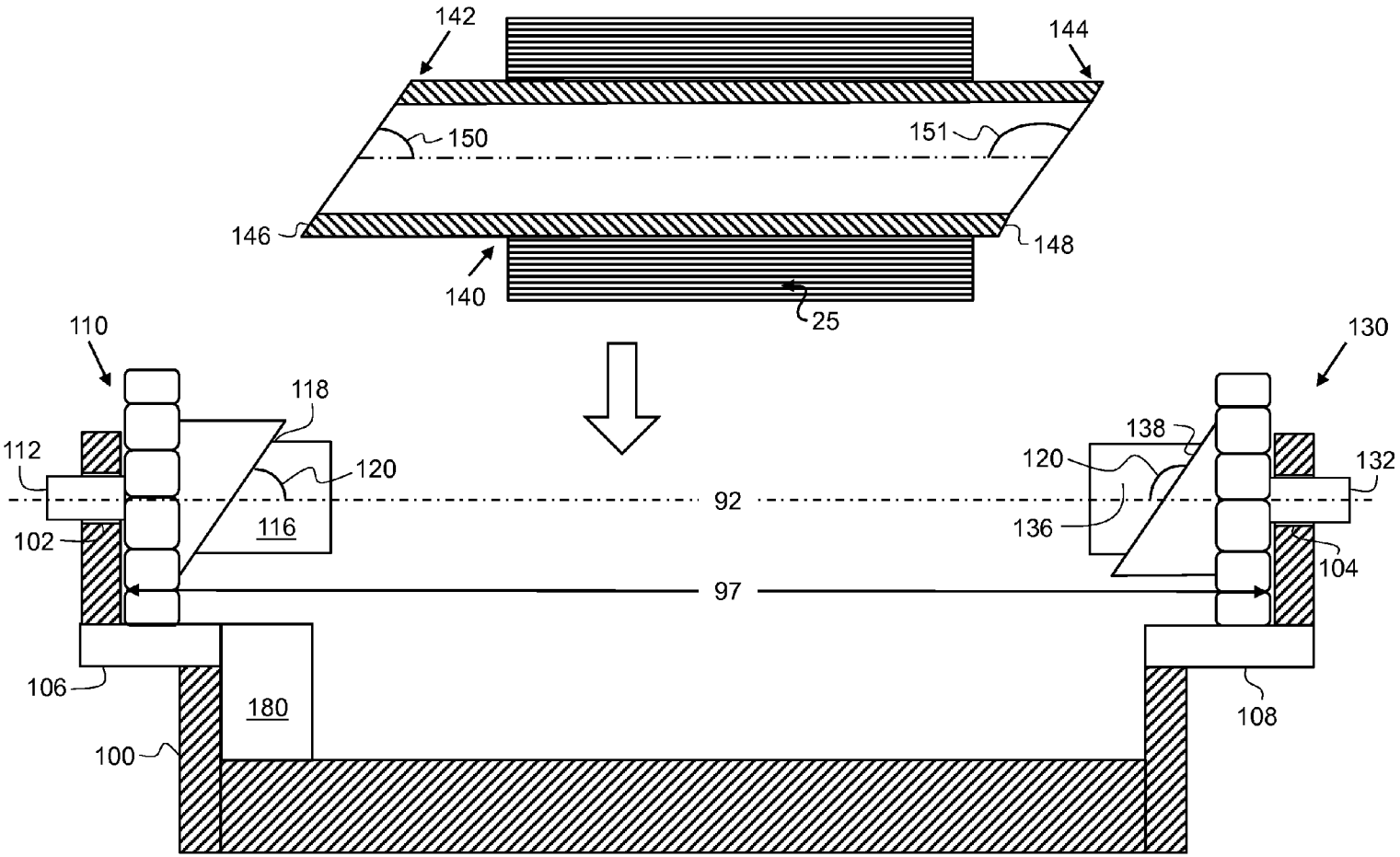
FIG. 12 illustrates the web supply system of the embodiment of FIG. 10 having both a first core mounting and a second core mounting having engagement angles that are not perpendicular to the axis of rotation separated for loading a core having engaged angles that are not perpendicular to the axis of rotation.
Figure 13:
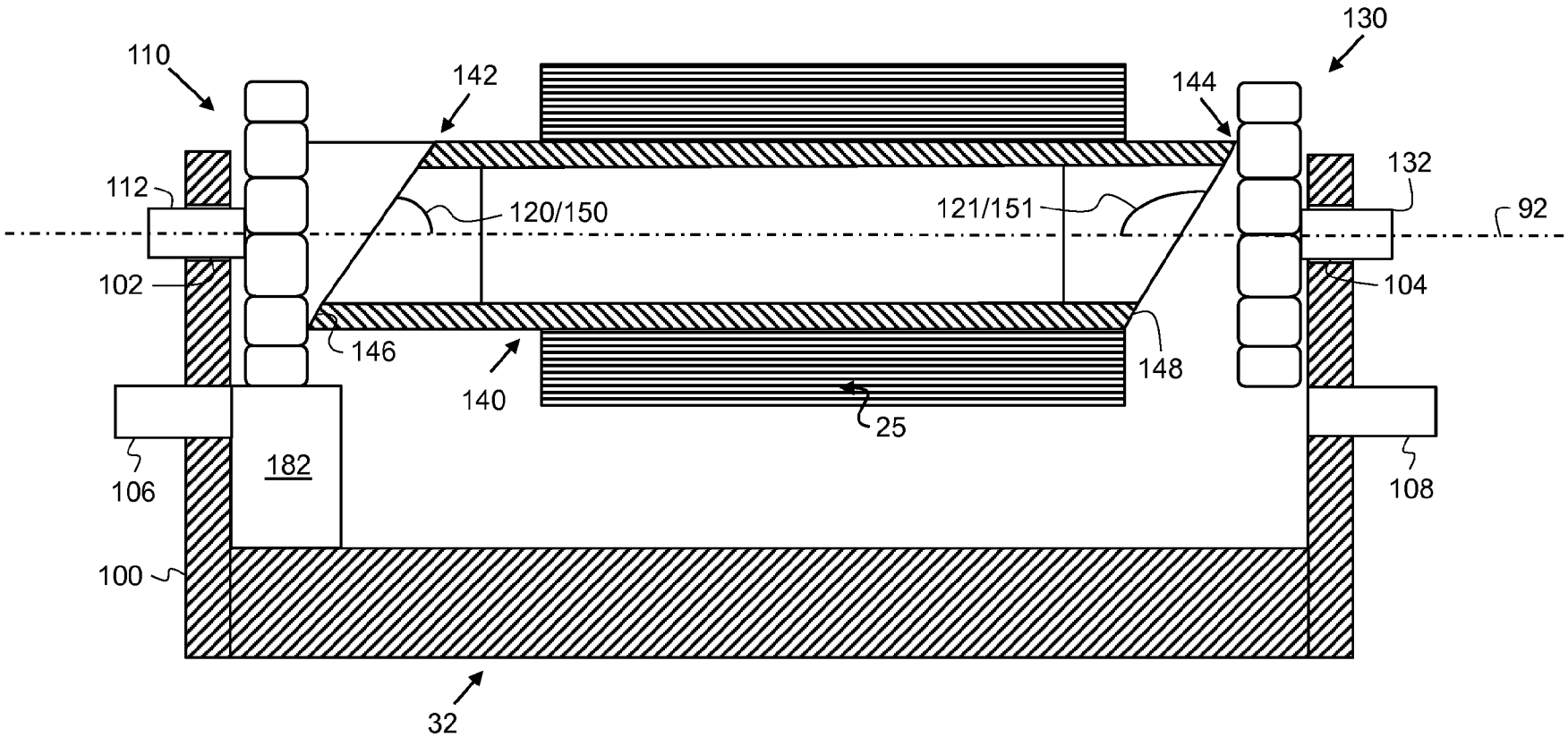
FIG. 13 illustrates the embodiment of FIG. 12 in a loaded position.
Figure 14:
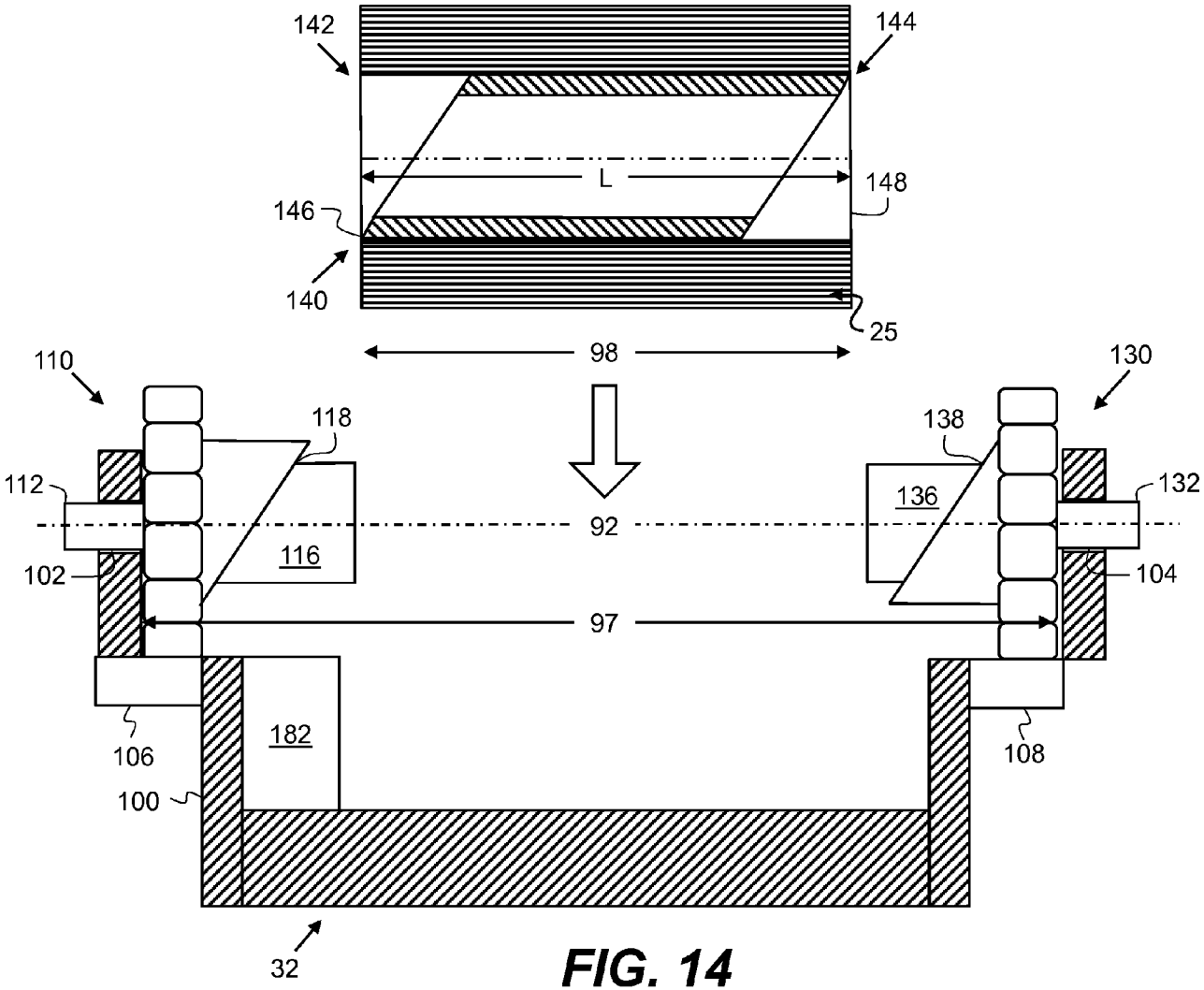
FIG. 14 illustrates another embodiment of a medium supply for use with a different embodiment of a core.

As shown in FIGS. 12, 13, and 14, in certain embodiments, web medium supply 32 can be used with a core 140 that has a first engaged surface 146 at first end 142 that is not perpendicular to an axis of rotation 82 of the core 140 and a second engaged surface 148 at second end 144 that is not perpendicular to the axis of rotation 82 of core 140. In such embodiments, web medium supply 32 provides a first core mounting 110 having a first engagement surface 118 at a first engagement angle 120 and a second core mounting 130 having a second engagement surface 135 at a second engaged angle 151 that correspond respectively to the first engaged angle 150 and a second engaged angle 151. As is shown in FIG. 13, where the first engagement angle 120 corresponds to the first engaged angle 150 and the second engagement angle 121 corresponds to the second engaged angle 151, core 140 can be supported by first core mounting 110 and second core mounting 130 for rotation about the axis of rotation 92.

However, where first engagement angle 120 and first engaged angle 150 do not correspond or where the second engagement angle 121 and second engaged angle 151 do not correspond, first core mounting 110 and second core mounting 130 do not support core 140 for rotation about axis of rotation 92 for the reasons generally described above.

It will also be appreciated that in addition to other advantages to be described below, cores 140 of this type can be used to provide an additional layer of protection against mis-loading of core 140 to web medium supply 32. Similarly, when cores 140 of the type illustrated in FIGS. 12 and 13 are used with web medium supply 32, web medium supply 32 provides a clear indication of an incorrect combination of a second end 144 of core 140 of this type with a second core mounting 120 resulting from any of the examples of mis-assembly described above in FIGS. 6-9 with reference to the first core mounting 110 and first end 142 of core 140.

Figure 15:
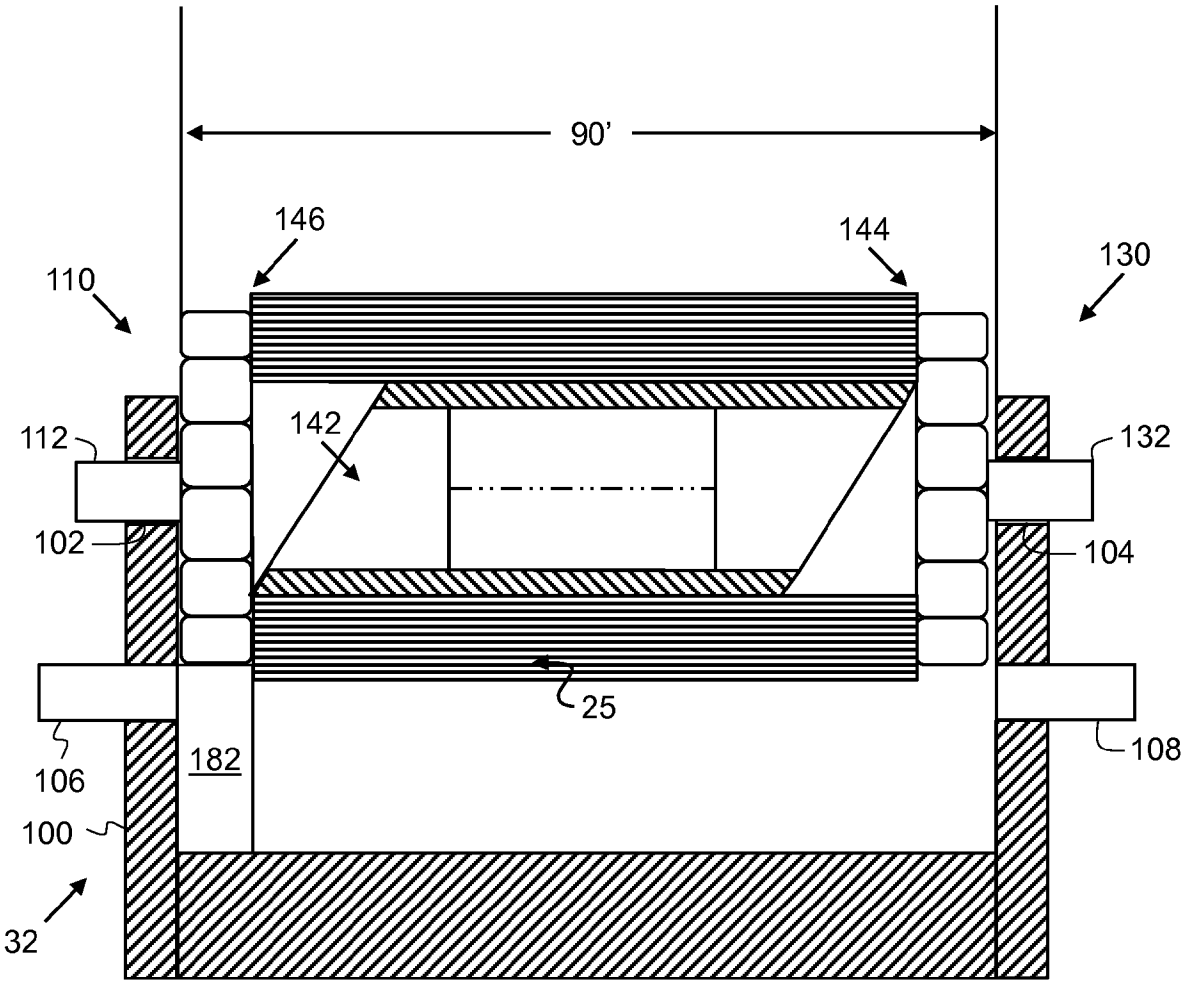
FIG. 15 shows the embodiment of FIG. 14 with the core of FIG. 14 loaded therein.

FIGS. 14 and 15 show another embodiment of a core 140 that can be used in any of the embodiments described herein but that is shown for example, in this embodiment used with the embodiment of web medium supply 32 consistent with that shown in FIGS. 12 and 13.

As is shown in FIG. 14 this embodiment, a core 140 is provided having a first end 142 and a second end 144 that are arranged such that a longest length L of core 140 between a the first end 142 and second end 144 is within a width 98 of a web 25 wound on core 140. This arrangement makes core 140 and web 25 more compact and of a less irregular shape. This facilitates shipping of core 140 and web 25, by lowering packaging costs and reducing the amount of space required of to ship core 140 and web 25. Further, this arrangement makes core 140 and web 25 less likely to be subject to an effect known as telescoping.

Telescoping can occur, for example, when a core 140 and a web 25 are dropped or otherwise subject to unequal loads or acceleration along the axis of rotation 82 of core 140. Such unequal loads can cause the core 140 to move along the axis of rotation 82 of core 140 relative to web 25 such that a portion of the mass of the web 25 shifts laterally along the length of core 140. This telescoping effect can occur where, for example, a core 140 and web 25 are dropped such that core 140 strikes the ground and decelerates at a rate that is significantly faster than the web 25 does. In such a case, core 140 immediately ceases movement while the mass of web 25 continues to move causing web 25 to uncoil while shifting laterally to create a telescopic appearance. Such telescoping issues can also arise where core 140 and web 85 are subject to a differential acceleration that can occur for example during shipping or transport. The telescoping of web 25 can be difficult to correct and can damage web 25.

In the embodiment of FIG. 14 and FIG. 15, the risk of such telescoping problems is substantially reduced by providing a core 140 that is, at a longest length within a width of a web 25 mounted thereon. As can be seen in FIG. 15, this arrangement also advantageously allows web medium supply 32 to be made smaller laterally, which allows web medium supply 32 to be made smaller because the separation distance 99 can be made smaller than, for example, a separation distance 90 as illustrated in FIGS. 2-4.

While first core mounting 110 and second core mounting 130 have been shown as being of a type that can have a first core support surface 116 and a second core support surface 136 respectively that support core 140 from an inside portion, it will be appreciated that in other embodiments, first core mounting 110 and second core mounting can support first end 142 of core 140 and second end 144 of core 140 by support structures that overlap first end 142 and a second end 144 of core 140 on an outside of core 140 to an extent that provides external support and that in such embodiments first engagement surface 118 and second engagement surface 138 will be positioned within the first core support surface 116 and second core support surface 136.

It will be understood that correspondence of a first engagement angle 120 to a first engaged angle 150 and correspondence of a second engagement angle 121 to a second engaged angle 151 do not require an exact match of angles as there are, of course, various degree of tolerances within any system involving multiple components and therefore the extent of correspondence required in any system can vary based upon the dimensional characteristics and stability of the web medium supply 32, the core 140, and the first core mounting 110 and the second core mounting 130, such as the lengthening of a core, the separation distance 90, the extent of engagement between core 140 and first core mounting 110 and second core mounting 130. In general, therefore, the first engaged angle 150 and the first engagement angle 120 correspond where the first engaged angle 150 and the angle of the first engagement angle 120 are such that core 140 can be mounted to first core mounting 110 and the second core mounting 130 such that a total length of the core 140, first core mounting 110 and second core mounting 130 is within separation distance 90 within which first core mounting 110 can be supported by the first mounting support 102 and the second core mounting 120 can be supported by the second mounting support 104 for rotation about the axis of rotation 92.

Determining Data Related to the Web

Figure 16:
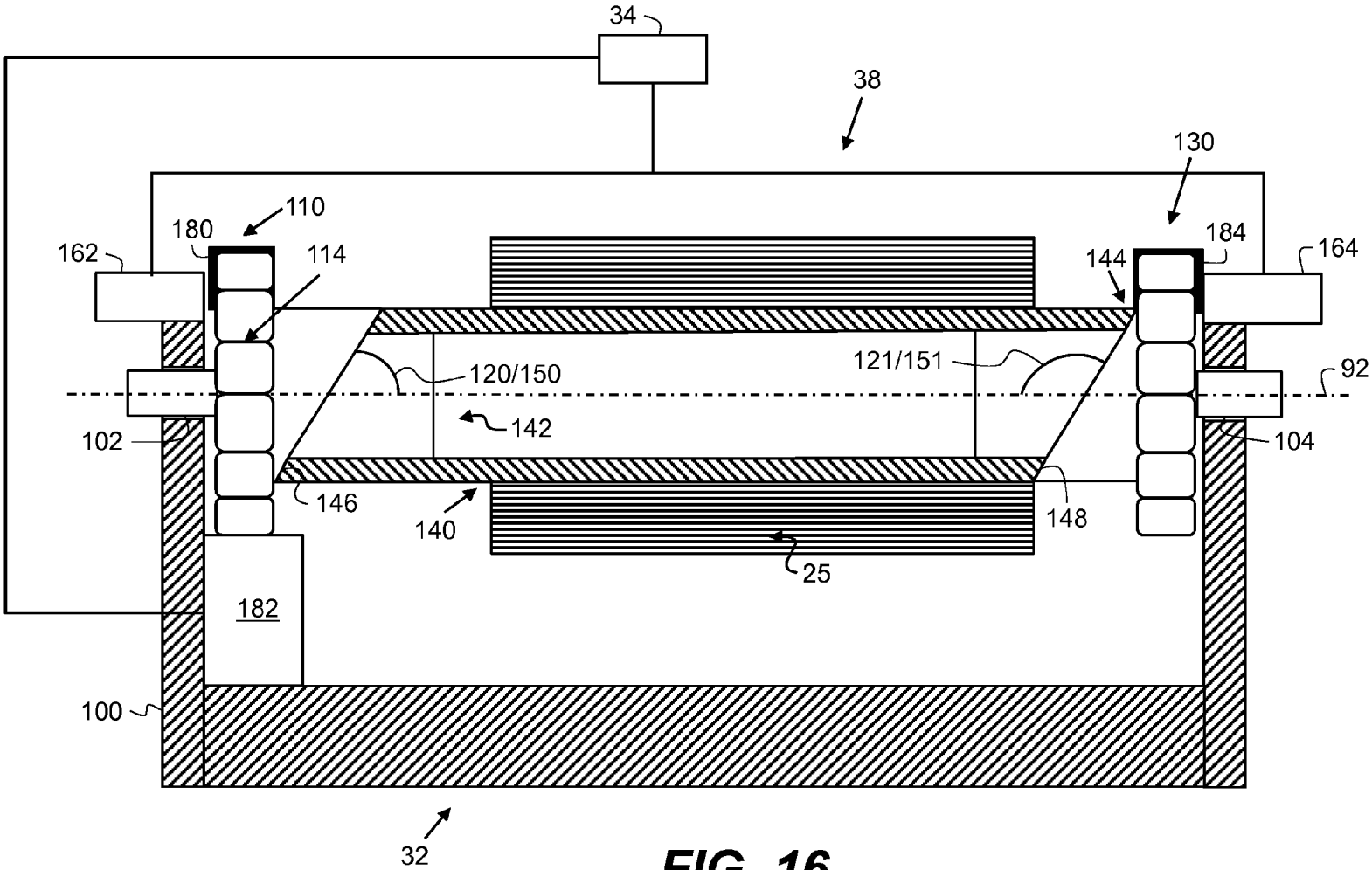
FIG. 16 shows another embodiment of a medium supply that can determine data regarding core loaded therein.

FIG. 16 shows a first embodiment of a web medium supply 32 that is adapted to determine data related to a web 25 of medium on a core 140. In this embodiment, a first engaged surface 146 of core 140 is provided with a first engaged angle 150 that is one of a plurality of different first engaged angles 150. Each of the plurality of different first engaged angles 150 is logically associated with different data. Accordingly, by providing a sensor system 38 that can sense the first engaged angle 150 or that can sense conditions that are indicative of the first engaged angle 150 on a core 140 data regarding a web 25 wound on core 140 can be determined.

Figure 17A:
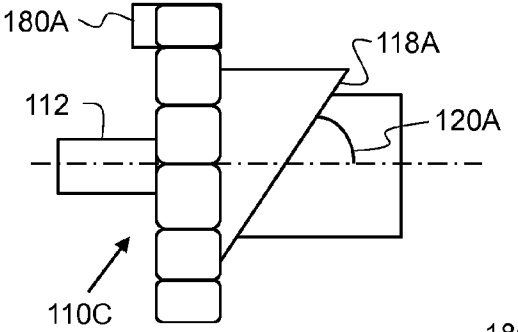
FIGS. 17A-17C show various first core mountings useful with the embodiment of FIG. 16.
Figure 17B:
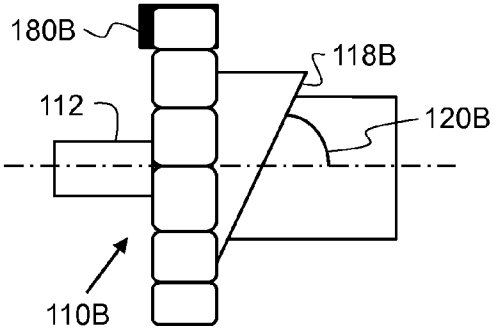
Figure 17C:
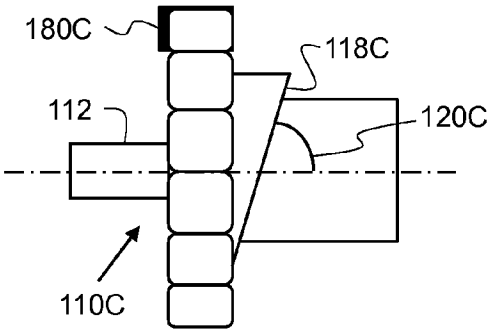

In the embodiment of FIG. 16 web medium supply 32 has a first mounting support 102 that is adapted to receive any of a plurality of different first core mountings 110, illustrated for example in FIGS. 17A, 17B and 17C, as first core mounting 110A, first core mounting 110B and first core mounting 110C.

As is illustrated in FIGS. 17A, 17B and 17C, a first core mounting 110A has a first engagement surface 118A that is at a first engagement angle 120A, another first core mounting 110B has a first engagement surface 118B at a first engagement angle 120B still another first core mounting 110C has a first engagement surface 118C with a first engagement angle 120C. First engagement angles 120A, 120B and 120C correspond to one of the plurality of first engaged angles and are logically associated with the data. Here, first engagement angles 120A, 120B and 120C are different. As is also illustrated in FIGS. 17A, 17B, 17C, each of the plurality of first core mountings 110A, 110B and 110C has one set of three different first detectable features 180A, 180B and 180C.

Accordingly, processor 34 can determine data associated with web 25 by detecting which one of first mounting 120A, 120B, or 120C is mounted to core 140 when core 140 is joined to first core mounting 110 and second core mounting 130 to form a core/mounting assembly 152 and the mounting/core assembly 152 is mounted between first mounting support 102 and second mounting support 104.

Returning to FIG. 16, it will be observed that sensor system 38 provides a first sensor 162 that is positioned relative to frame 100 such that first sensor 162 can sense any of first detectable features 180A, 180B and 180C. When first sensor 162 senses one of the plurality of first detectable features 180A, 180B, and 180C, first sensor 162 generates a first sensor signal from which processor 34 can determine which one of first detectable features 180A, 180B and 180C is on a first core mounting 110.

Processor 34 can then determine data regarding web 25 wound on core 140 based upon this information. This can be done, for example by referencing a look up table (LUT) that correlates each of the first detectable features 180A, 180B and 180C that can be used to determine characteristics of the web 25 wound on core 140.

Figure 17D:
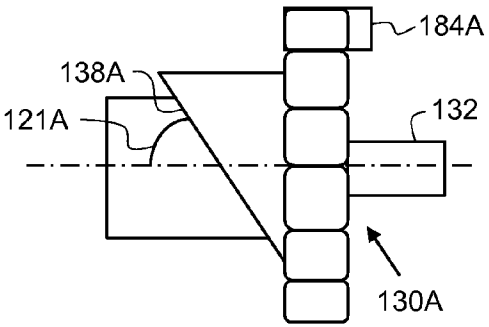
FIGS. 17D-17E show various optional second core mountings useful with the embodiment of FIG. 16.
Figure 17E:
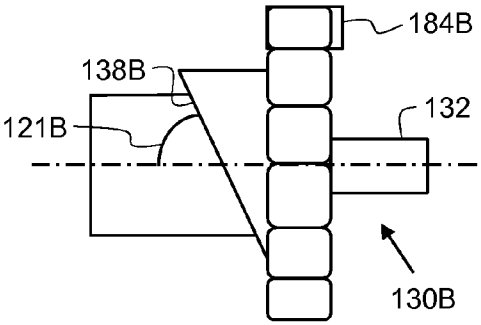
Figure 17F:
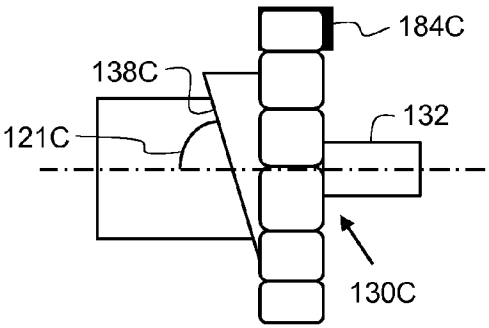

In the embodiments of FIG. 16, sensor system 38 is shown having an optional a second sensor 164 that is positioned relative to frame 100 such that second sensor 164 can sense an optional second detectable feature 184 on second core mounting 130. This allows additional information to be provided on core 140 by defining core 140 to further have a second engaged surface 148 that is at one of a plurality of second engaged angles 151 each associated with some additional data. Here too, second sensor 164 can sense second engaged angle 151 or second sensor 164 can sense conditions that are indicative of the second engaged angle 151 and the additional data can be determined. In the embodiment of FIG. 16, this sensing is likewise done for example, by sensing which of a plurality of second detectable features of a plurality of second core mountings 130 shown in FIG. 17D, 17E, and 17F is to second end of core 140 when positioned in second mounting support 104.

As is illustrated in FIG. 16, an actuator 182 is provided that is responsive to processor 34 to provide a force that, for example, can be used to control rotation of core 140, for example, to cause core 140 urge core 140 to rotate or to come to rest. In the embodiment shown in FIG. 16, actuator 182 comprises a motor that engages a first drive surface 114 of first core mounting 110 and transfers forces from actuator 182 to drive rotation of core 140. However, accurate rotation of core 140 can require some degree of feedback. Accordingly, first sensor 162 or second sensor 164 can be used for the additional purpose of sending signals to processor 34 from which processor 34 can determine a rate of rotation of core 140 and can send signals to actuator 183 to adjust a rate of rotation. In an alternative embodiment, actuator 182 can alternatively drive a second drive surface 134 on second core mounting 130 rather than driving first core mounting 110. In still other embodiments, not illustrated, actuator 182 can be positioned on frame 100 such that it can apply urging forces to either first surface 112 or second surface 132 to influence rotation of core 140. In any of these configurations the use of signals from first sensor 162 or second sensor 164 can be used to provide such feedback signals in addition to providing sensing of first detectable feature 180 and second detectable feature 184 respectively.

Figure 18:
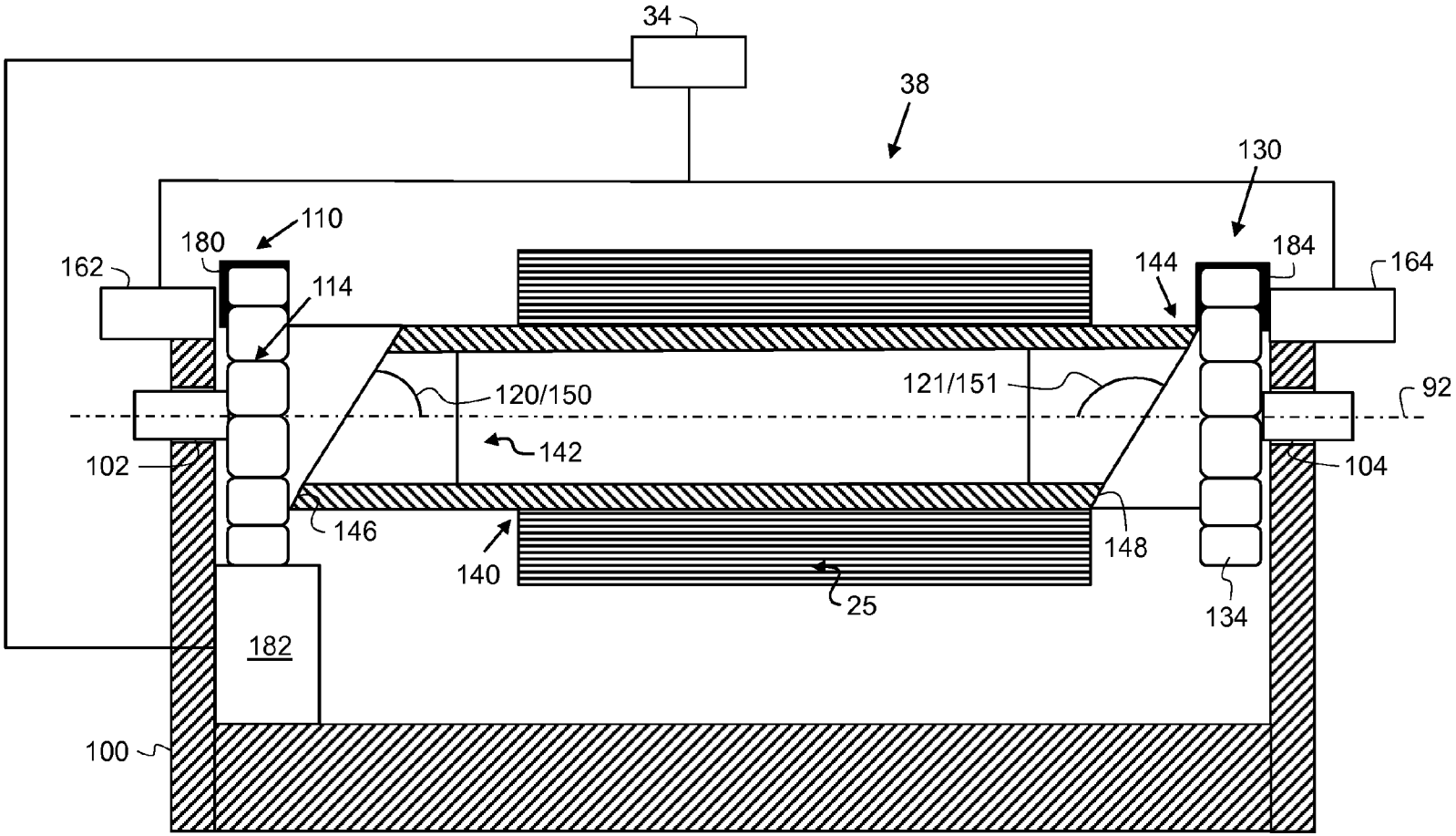
FIG. 18 illustrates another embodiment of a web supply system.

FIG. 18 shows another embodiment of a web medium supply 32 that can be used to determine data related to a web 25 of medium on a core 140. In this embodiment, this determination is made based upon the relative rotational positions of first engaged surface 146 and second engaged surface 148 about the circumference of core 140. In this regard, it will be appreciated that first engaged surface 146 and second engaged surface 148 generally follow cylindric sections across core 140. These cylindric sections can be taken at any rotational position around core 140. Accordingly, for a particular core 140 first engaged surface 146 can follow a cylindric section taken at a first rotational position while second engaged surface 148 can follow a cylindric section taken at a second rotational position. Data can be associated with particular positional relationships such that the data regarding the web 25 on core 140 can be determined by sensing the rotational position of first engaged surface 146 and second engaged surface 148 or by sensing conditions that are indicative of the relative rotational positions.

FIGS. 19A-19E illustrate a plurality of different cores 140A, 140B, and 140C that can have data that is associated with the separation between the rotational position of first engaged surfaces 146A, 146B, 146C and the rotational positions of second engaged surfaces 148A, 148B and 148C. As is shown here, first engaged surface 146A is at a first rotational position 170A second engaged surface 148B is at a second rotational position 170B and second engaged surface 148C is at a third rotational position 170C relative to position of first engaged surface 146. For clarity, first engaged surface 146 is maintained in the same position for each of the cores 140A, 140B and 140C.

Figure 19A:
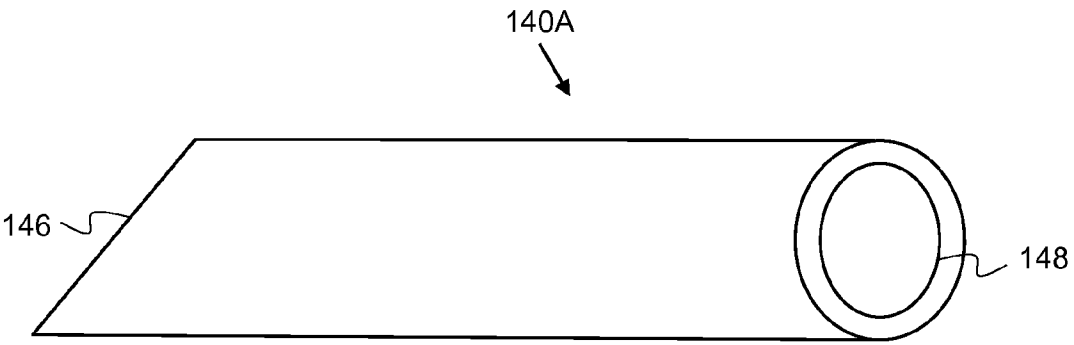
FIGS. 19A-19F illustrate various embodiments of cores having different rotationally positioned edges useful with the embodiment of FIG. 18.
Figure 19B:
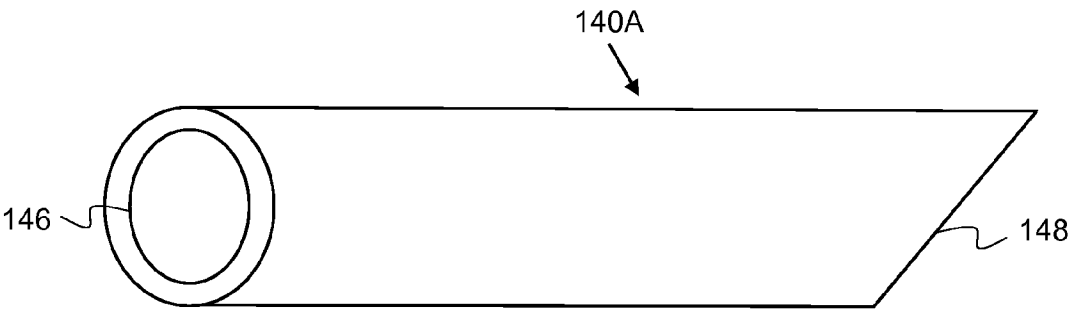
Figure 19C:
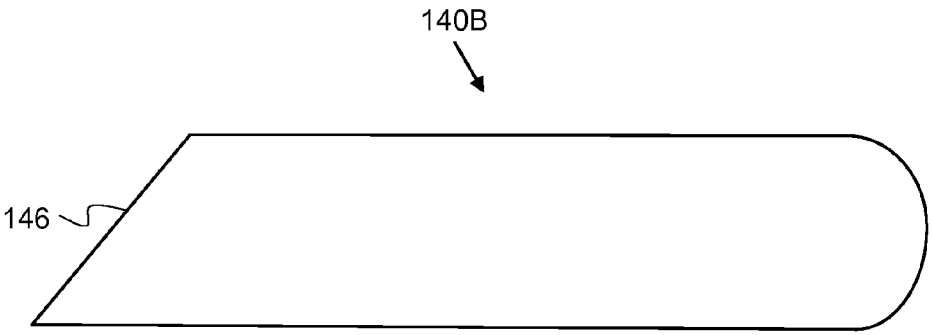
Figure 19D:
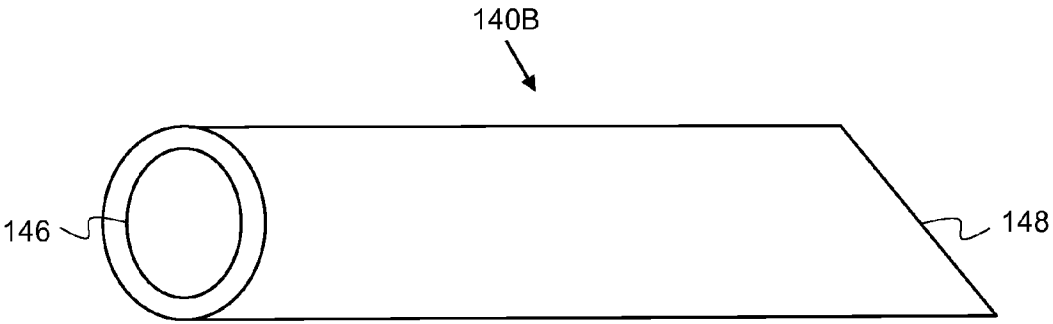
Figure 19E:
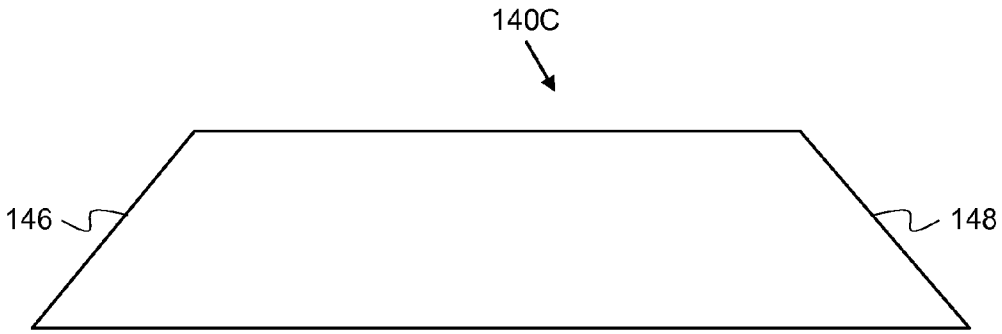
Figure 19F:
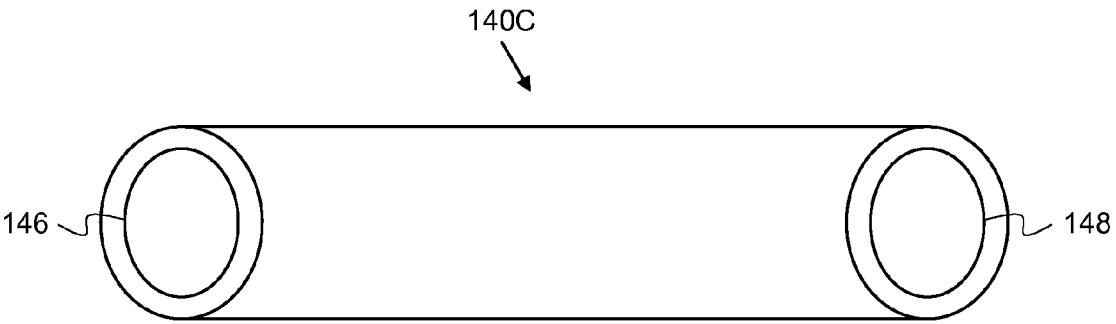

As is shown in a side view in FIG. 19A and as illustrated in top view in FIG. 19B core 140A at second engaged surface 148 has a 90 degree offset from first engaged surface 146A and faces in the direction of the side view. This rotational separation can be associated with first data regarding a web (not shown) on core 140A. Core 140B is shown in a top view in FIG. 19C and in a side view in FIG. 19D as having a second engaged surface 148 that is at a rotational position that is also 90 degrees offset from the rotational position of the first engaged surface but in the opposite direction this relative rotational separation can be associated with second data regarding a web (not shown) on core 140B. Further, as is also shown in FIG. 19E and in top view in FIG. 19F, another core 140C has a second engaged surface 148 at the same rotational position as first engaged surface 146 and therefore provides no rotational separation. This relative rotational separation can be logically associated with third data regarding a web 25 on core 140C.

Figure 20A:
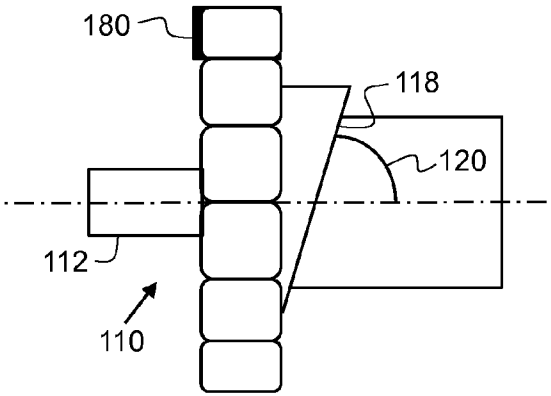
FIGS. 20A-20B illustrate alternative embodiments of core mountings useful with the cores of FIG. 19A-19F.
Figure 20B:
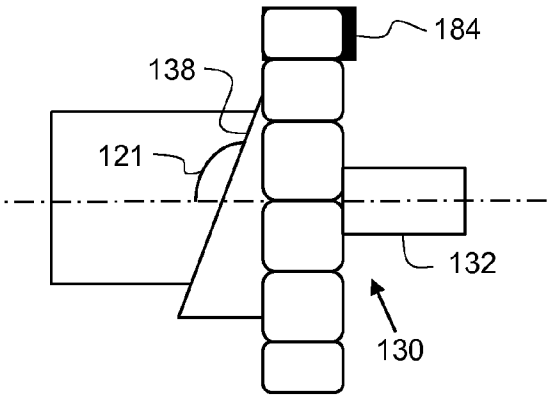

FIGS. 20A-20B show a first core mounting 110 and a second core mounting 130 that can be used with any of cores 140A, 140B and 140C shown in FIGS. 19A-19F. As is shown in FIG. 20A, first core mounting 110 has a first detectable feature 180 at a first rotational position and that has a known rotational positional relationship with the rotational position at which first engagement surface 118 is taken. In FIG. 20A these rotational positions are shown at an aligned rotational relationship. FIG. 2013 shows a second core mounting 130 that can be used with any of cores 140A, 140B and 140C. As is shown in FIG. 20B second core mounting 130 has a second detectable feature 184A that is at a second rotational position 175 and that is at a known positional relationship with the second engagement surface 138. Here in FIG. 2013 the positional relationship is an opposing positional relationship with second detectable feature 184 being arranged 180 degrees from an angle at which second engagement surface 138 is taken.

Returning to FIG. 18, core 140A is illustrated as being joined to first core mounting 110 and to second core mounting 130 and loaded within frame 100 for rotation about axis of rotation 92. In this embodiment, printer 20 has a web medium supply 32 having a first sensor 162 and a second sensor 164 joined to frame 100 and positioned to sense, respectively when first detectable feature 180 is rotated past first sensor 162 and when second detectable feature 184 is rotated past second sensor 164.

Figure 21:
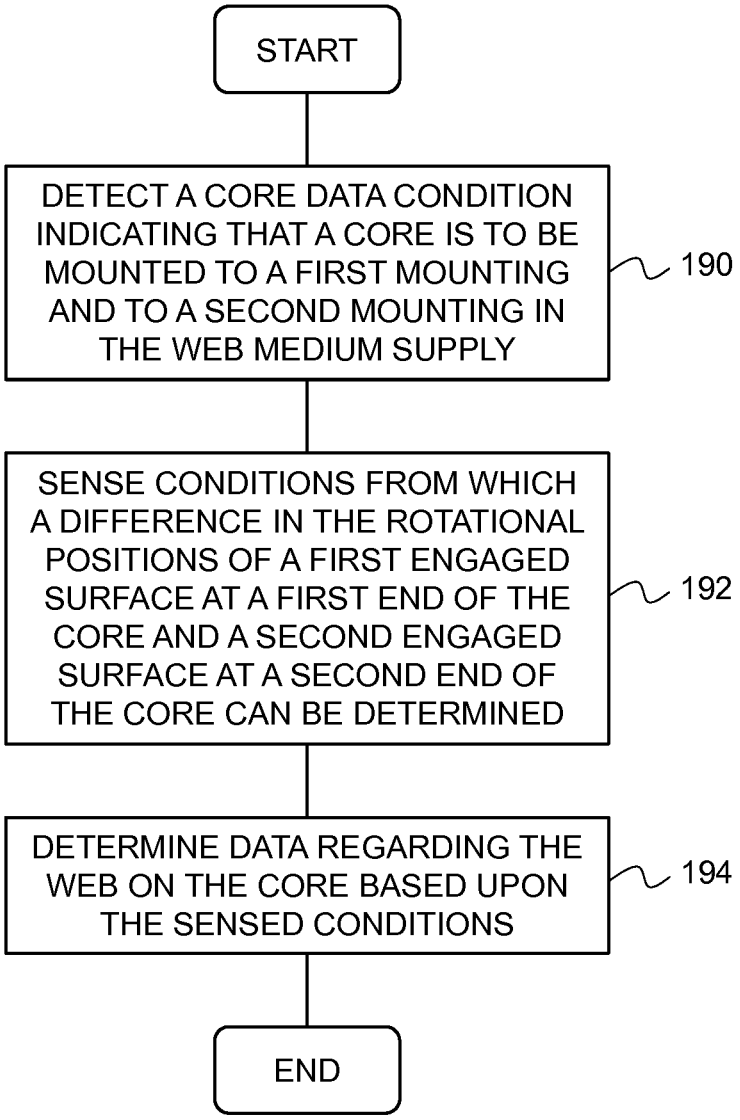
FIG. 21 shows an embodiment of a method for determining data associated with a cores of FIGS. 19A-19F using the medium supply of FIG. 18 and the core mountings of FIGS. 20A-20B.
Figure 22:
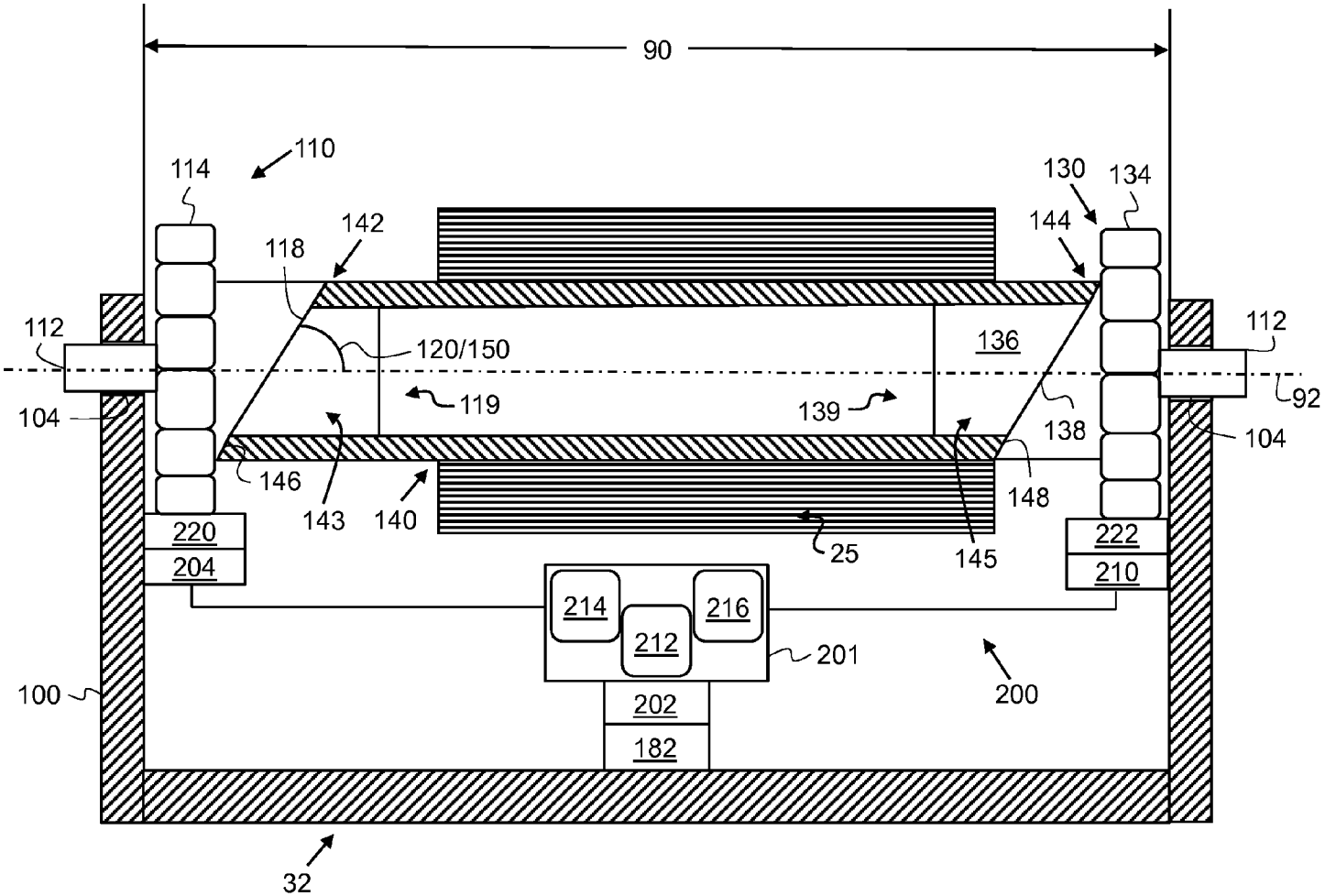
FIG. 22 shows an embodiment of a web medium supply that controls rotation of a core using a first force that is applied at a first end of the core and a second force applied at a second end of the core.

FIG. 21 shows a first embodiment of a method for operating a web medium supply 32 of a printer 20 to determine data regarding a web 25 on a core 140 such as core 140A. As is shown in the embodiment of FIG. 22 in a first step (step 190), a core data condition is detected indicating that an automatic core data acquisition process is to be executed. In one embodiment, a core data condition can be a signal received from user input system 36 indicating that a new core is to be installed in web medium supply 32.

In other embodiments, sensor system 38 of printer 20 can include sensors that can detect when a web medium supply access door or panel (not shown) has been opened, when a load that is borne by a first mounting support 102 or a second mounting support 104 is transitions from a loaded condition to an unloaded condition, when a core 140 is not positioned between first core mounting 110 and second core mounting 130 or when there is insufficient web 25 on core 140.

In still other embodiments, operational conditions can be calculated or automatically determined that indicate that a change of cores is required or that it is required to load a core between the first core mounting and the second core mounting. This can occur, for example where there is a need to change or replace a receiver medium or donor medium because of operating conditions. A core data condition can also arise at a startup or reset of printer 20. When any of these conditions or any other condition suggests that capturing or verifying data regarding a web 25 on a core 140 would be useful or appropriate is sensed or determined by processor 34 for printer 20 can determine that the core data condition exists.

After such a core data condition is sensed or determined processor 34 causes sensor system 38 to sense conditions from which a difference in the rotational positions of a first engaged surface 146 at a first end 142 of a core 140 and a second engaged surface 148 at a second end 144 of core 140 can be determined (step 192). There are a variety of ways in which this can be done automatically. For example, in the embodiment of FIG. 18, processor 34 can cause actuator 182 to rotate first mounting 110, core 140A and second core mounting 130 after a core such as core 140A mounted to first core mounting 110 and second core mounting 130. During rotation, a rotational position of a first detectable feature 180 on first core mounting 110 is sensed and a rotational position of second detectable feature 184 on second core mounting 130 is sensed.

As is illustrated in FIG. 20A first core mounting 110A has a first detectable feature 180 at a known rotational position with respect to first engagement surface 118. For the reasons discussed above, first engagement surface 118 corresponds to first engaged surface 146A of core 140A and arranged in a fashion that has first engagement surface 118 rotationally aligned with the first engaged surface 146 of a core 140 when mounted in frame 100. Accordingly, the rotational position of first detectable feature 180 is indicative of the rotational position of the first engaged surface 146A of core 140A.

Similarly, as is illustrated in FIG. 20B, second detectable feature 184 on second core mounting 130 has a known rotational position with respect to second engagement surface 138 for the reasons also discussed above, is rotationally aligned with second engaged surface 148A of core 140A to second end 144 of core 140 and when assembled mounted in frame 100 such that the rotational position of the second detectable feature 184 is indicative of the rotational position of second engaged surface 148. In one example, rotational positions can be assigned by sensing when during rotation, the first detectable feature 180 of the first core mounting 110 is sensed by sensor system 38 and the second detectable feature 184 of the second core mounting 130 is sensed by sensor system 38.

In the embodiment of FIG. 18, sensor system 38 uses first sensor 162 and second sensor 164 to detect first detectable feature 180 and second detectable feature 184, however, other sensors can be used. For example, sensor system 38 can provide an arrangement of sensors (not shown) that can be provided at fixed locations about the path of rotation the first core mounting 110 and second core mounting 130 such that the rotational position of first detectable feature 180 and second detectable feature 184 can be determined without rotation of core 140.

Alternatively, sensor system 38 can have a first sensor 162 and second sensor 164 positioned as indicated in FIG. 18 and capable of sensing the relative rotational positions of a first detectable feature 180 and second detectable feature 184 without rotating core 140. This can be done where first detectable feature 180 and second detectable feature 184 provide a plurality of differentiable portions positioned at different rotational positions on the first core mounting 110 and the second core mounting such that sensor system 38 can provide signals that are indicative of the relative rotational positions of first core mounting 110 and second core mounting 130 from which the relative rotational positions can be determined. For example, the first detectable feature 180 and second detectable feature 184 can be provided such that they can be sensed with different intensities at various rotational positions of first core mounting 110 and second core mounting 130. Processor 34 can then determine the rotational position of the first core mounting 110 and second core mounting 130 based upon the intensity of the portions of first detectable feature 180 and second detectable feature 184 confronting first sensor 162 and second sensor 164.

In another embodiment, the rotational positions of the first engaged surface 146 and second engaged surface 148 can be sensed by determining an initial rotational position of a first core mounting 110 and a second core mounting 130 when a core data condition is sensed and detecting an amount of rotation of the first core mounting 110 and the second core mounting 110 required to enable the core 140A to be mounted on first core mounting 110 and second core mounting 130. Optionally, the rotational positions of first core mounting 110 and second core mounting 130 can be mechanically reset to a reference position upon detecting the core data condition either by active controlled movement of the first core mounting 110 and second core mounting 130 by one or more actuators (not shown) or by passive controlled movement of first core mounting 110 and second core mounting 130 such as can occur where the first core mounting 110 and second core mounting 130 are mechanically biased to a neutral position by a spring or other resilient member or actuator (not shown).

Data regarding a web 25 on the core 140A is then determined based upon the sensed conditions (step 194). In this regard, processor 34 can then determine data regarding web 25 wound on core 140 based upon signals from the sensor system 38 from which a rotational position of the first detectable feature 180 and second detectable feature 184 can be determined. This can be done, for example, by referencing a look up table (LUT) that correlates rotational positions of first detectable feature 180 and second detectable feature 184 with particular data that can be used to determine characteristics of the web 25 wound on a core 140. Alternatively, rotational positions of first detectable feature 180 and second detectable feature 184 can be used to determine the rotational positions of the first engaged surface 146 and the second engaged surface 148 using a LUT that correlates rotational positions of the first engaged surface and the second engaged surface or a calculated rotational separation between the first engaged surface 146 and the second engaged surface 148 with particular characteristics of a web 25. Other forms of logical association can be used.

The data determined from the look up table or other logical association can itself provide data regarding the web 25 on the core 140A or the determined data indicate reference data that can be used to obtain regarding the web 25 from a reference source, such as data that instructs processor 34 where such data can be obtained or derived for example, from a particular memory location which can be local or in a remote memory system 52 such as a remote data server or that provides data that can be used to identify a formula or other calculation that can be used to calculate information regarding the web, or data that can be used in such a formula.

Processor 34 can use this data to establish appropriate parameters for printing using the web. This data can be used to adjust the printing process or to obtain data that can be used to adjust the printing process based upon the characteristics of the web medium. For example, and without limitation, the data can be indicative of web characteristics including surface gloss, thickness, age of the medium, the batch of the medium, grain direction, dye composition, manufacturer identification, density information, and color information. Processor 34 can use such data to establish printing speeds, color densities, the need for an overcoat, the need for gloss adjustment or any of a number of operating characteristics of a printer.

In this manner it is possible to provide data that is associated with any of a plurality of different webs by winding each different web 25 on one of a plurality of cores 140 having different rotational positions of a first engaged surface 146 at a first end 142 of the core 140 and rotational positions of a second engaged surface 148 at a second end 144 of the core 140 such that the separation between the rotational position the first engaged surface 146 and the second engaged surface 148 are indicative of data related to the web 25 recorded thereon. Further, such data can be obtained by steps of sensing the rotational position of the first core mounting 110 and the second core mounting 130 and determining the data based either upon the separation of the rotational positions of the first core mounting 110 and second core mounting 130 or by using the separation of the rotational separation between the first core mounting 110 and second core mounting 130 to determine the rotational position of the first engaged surface 146 and the rotational position of the second engaged surface 148 from which the data is then determined.

The first detectable feature 180 and second detectable feature 184 can take many forms including but not limited to optically detectable features such as comparatively reflective or comparatively dark areas of first core mounting 110 and second core mounting 130 or such as openings in first core mounting 110 or second core mounting 130, mechanically detectable features, electrically detectable features, or electromagnetically detectable features.

The first detectable feature 180 and the second detectable feature 184 can be assembled to first core mounting 110 and second core mounting 130. Alternatively, the first detectable feature 180 and the second detectable feature 184 can be formed from a common substrate with first core mounting 110 and second core mounting 130 or otherwise fabricated with the first core mounting 110 and the second core mounting 130 such as where the first core mounting 110 and second core mounting 130 are fabricated having surface features from which first detectable feature 180 and second detectable feature 184.

Sensor system 38 can use sensors of conventional design such as electro-optical, electro-mechanical, electromagnetic or other sensors that can detect such embodiments of detectable features 180 and 184. Sensor system 38 need only be capable of sensing when a first detectable feature 180 or second detectable feature 184 is present in a defined area relative to the sensor system 38 or of generating a differentiable signals that allows discrimination between portions of first detectable feature 180 or of second detectable feature 184 that are distributed rotationally around the first core mounting and the second core mounting to indicate which portion is in a defined area relative to sensor system 38, any known sensor that can detect any feature of first core mounting 110 or second core mounting 130 ways can be used for this purpose. In the embodiment of FIG. 18 there is no requirement that the sensor system 38 is capable of reading any data encoded in markings or RFID transponders.

It will also be appreciated that this arrangement is highly robust as the detected planes are not as vulnerable to damage as markings or RFID tags and as generic core 140 to be used to load all of a plurality of different webs 25, the conditions that must be sensed to determine the rotational positions on phase differences between cores such as cores 140A, 140B, and 140C that can be automatically detected during loading or during rotation with presence/absence type sensors and sensing systems, or intensity type sensors.

Optionally, the first engaged angle 150 or second engaged angle 151 or the rotational positions at which first engaged surface 146 or second engaged surface 148 are provided can be defined on a core 140 after web 25 has been wound thereon using slicing, cutting, or other processes that can be quickly and cleanly executed thus allowing a core 140 to have these features.

The different rotational positions of the first core mounting 110 and the second core mounting 130 shown in the embodiment of FIG. 19A-19F are exemplary only. A large number of potential rotational separations are possible and plurality of cores is possible that can be used to provide data regarding a large number of different webs. It will be appreciated by using this method, a sensor system 38 generate signals from which data regarding the web 25 on a core 140 can be determined while being simpler and more robust than readers required to read markings or to sense RFID tags. Accordingly, a low cost and high reliability method is provided that can provide information regarding a large number of different web mediums.

Core Drive Arrangements

As is generally noted above, the inertial loads created by a core 140 and associated web 25 can be significant. To control movement of core 140 control forces are generated using an actuator and then these forces are applied through, for example, first core mounting 110 to core 140. To do this successfully, core 140 itself should be capable of responding to such forces without either disruptively damaging core 140 and without slipping relative to first mounting 110. The design of a core 140 that meets these requirements would suggest the use of a core that has a certain range of size or weight or that is made from specialty materials or complex designs. While such an approach can yield commercially viable and highly useful systems, such an approach can limit design freedom with respect to the size, weight, complexity or cost of printer 20. Further the core cost, complexity, weight or volume will be multiplied by the number of cores that web medium supply 32 is adapted to supply and therefore the design of a core 140 can have a meaningful influence on the total cost of size of a printer 20 and can also influence the per print cost of such a printer.

Conversely, to the extent that the size, weight or component cost of the cores 140 used in web medium supply 32 of printer 20 can be reduced, it is possible to achieve reductions in the size, weight or complexity of components of web medium supply 32 and printer 20, and the benefits of such reductions will also be multiplied by the number of cores 140 web medium supply 32 is adapted to supply.

With objectives of securing any of these and other benefits in mind, FIG. 22 shows a schematic view of another embodiment of a web medium supply 32. As is shown in FIG. 22, web medium supply 32 comprises a frame 100 having a first mounting support 102 and second mounting support 104 that are positioned along an axis of rotation 92 and separated by a separation distance 90 during the supply of web 25.

First core mounting 110 is also provided having a first surface 112 that is supportable by the first mounting 102 for rotation about the axis of rotation 92 and a first engagement end 119 to which a first end 142 of a core 140 can be mounted. First core mounting 112 also has a first engagement surface 118 through which a first force urging the first core mounting 110 to rotate can be transmitted to core 140 to urge core 140 to rotate with first core mounting 110.

A second core mounting 130 is also provided having a second surface 132 that is rotatably supportable by the second mounting 104 for rotation about the axis of rotation 92 second core support surface 136 to which a second end 144 of the core 140 can be mounted. Second core mounting 112 also has a second drive surface 134 through which a second force urging the second core mounting 130 to rotate can be transmitted to core 140 to urge core 140 to rotate with second core mounting 130.

As is shown in FIG. 22, web medium supply 32 has a drive transmission 200 with an input end 202, a first output 204 mechanically linked to first core mounting 110 to apply the first force to first core mounting 110 and a second output 210 mechanically linked to second core mounting 130 to apply the second force to second core mounting 130.

Figure 23:
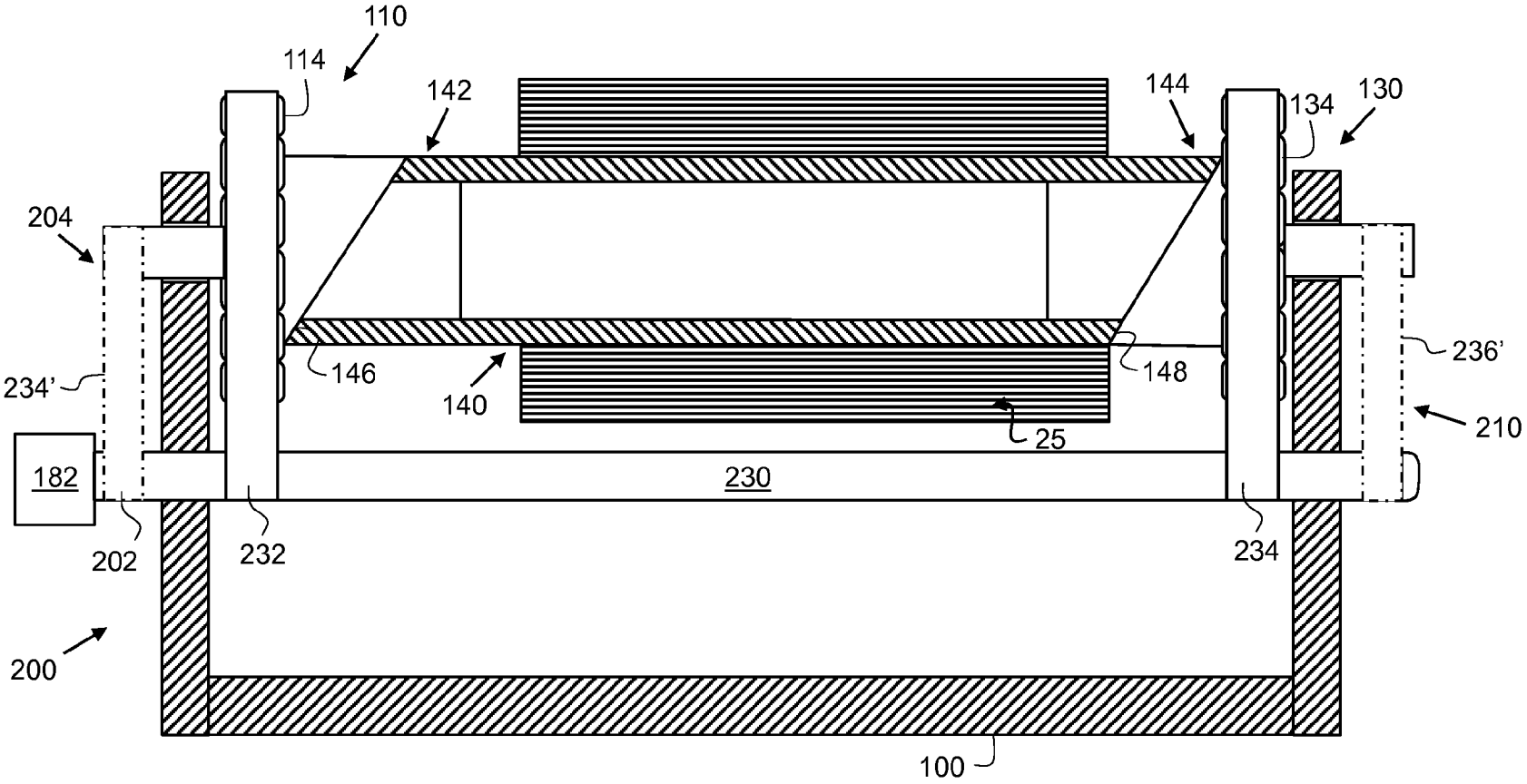
FIG. 23 shows another embodiment of a web medium supply that controls rotation of a core using a first force that is applied at a first end of the core and a second force applied at a second end of the core.

In the embodiment that is illustrated in FIG. 23, drive transmission 200 mechanically links input end 202 to first output 204 and to second output 210 and distributes an amount of force supplied at input end 202 to first output 204 and to second output 210 so that first output 204 and second output 210 respectively apply the first force to first core mounting 110 and the second force to second core mounting 130 such that the first force and the second force can, in combination, control rotation of first core mounting 110, second core mounting 130, core 140 and web 25.

In this embodiment, drive transmission 200 is shown with a transmission linkage 201 linking input end 202 to first output 204 and second output 210 by way of an input gear 212, a first output gear 214 and a second output gear 216 that directly intermesh to drive first output 204 and second output 210 such that first output 204 and second output 210 rotate according to the same input force. In this embodiment, first output gear 214 and second output gear 216 match so that first output 204 and second output 210 move at the same rate of rotation and in phase in response to rotation of input end 202, for example, by an actuator 182. In this way, the embodiment of drive transmission 200 illustrated in FIG. 22 can ensure that first end 142 and second end 144 of core 140 are held in a range of rotational positions relative to each other. This arrangement of drive transmission 200 is not limiting and other conventional types of transmissions can be used to the extent that such other conventional transmissions perform the functions described herein.

As is also shown in the embodiment of FIG. 22, first output 204 is mechanically linked to first drive surface 114 of first core mounting 110 to provide an interface through which the first force can be applied, while second output 210 is mechanically linked to second drive surface 134 of second core mounting 134 to provide an interface through which the second force can be applied.

In the embodiment illustrated in FIG. 22, first drive surface 114 is geared and is mechanically linked to first output 204 by way of an intermeshing first drive gear 220 that is driven by first output 204. Similarly second core mounting 130 has a second drive surface 134 that is geared and that is mechanically linked to intermeshing second drive gear 222 that is driven by second output 210. In one embodiment, first drive gear 220 and first drive surface 114 are geared so that they intermesh in the same way that second drive gear 222 and second drive surface 134 intermesh so that an amount of input from first output 204 and second output 210 will cause the same amount of rotation of first core mounting 110 and second core mounting 130.

In certain embodiments, it may be necessary or useful to provide differential gearing of first output gear 214 and second output gear 216. This can be done as desired to the extent that any differences in output caused by such differences can be compensated for by way of other systems to ensure that the first end 142 and second end 144, of core 140 maintain a rotational position that is within a range of rotational positions. For example, it may be useful or necessary to compensate for differences in the gearing of first output gear 214 and second output gear 216 through differences in the way in which first drive gear 220 and first drive surface 114 and second drive gear 222 and second drive surface 134 intermesh. This allows for some flexibility in the design of the overall system as may be necessary to support other considerations in the design of the overall printer 20.

It will be appreciated that by driving core 140 from both first end 142 and second end 144 in phase, the first end 142 and second end 144 of core 140 will remain within a fixed range of rotational positions relative to each other, and the amount of torque experienced in core 140 at each of first end 142 and second end 144 will be significantly reduced as compared to an alternative where, for example, all of the torque created by the inertial load of core 140 and associated web 25 must pass through one end of core 140.

Because the amount of torque required to provide controllable rotation of core 140 and web 25 including that required manage the inertial loads is applied through first end 142 and second end 144, a first yield strength of core 140 at first end 142 and a second yield strength of core 140 at second end 144, can be lower than a third yield strength required of an alternative core (not shown in FIG. 22) having the same web 25 thereon and but that is driven only from first end 142 or second end 144. Accordingly, a core 140 driven in this way can be made smaller lighter, or of less costly materials or of a simpler design than such an alternative core.

It will also be appreciated that in these embodiments the first force is transferred from first core mounting 110 to first end 142 of core 140 at the interface between first engagement surface 118 and first engaged surface 146. This provides an area of driving contact that circumscribes core 140. Accordingly there is no opportunity for slippage of first core mounting 110 relative to core 140. Further, the extent of such contact area ensures that there is tolerance for incidental damage to a portion of core 140 while still allowing the use of core 140 with first core mounting 110. Thus first end 142 can be damaged to an extent that would destroy, for example, a notch used in a conventional interface between a core and a mounting while still remaining useful. Similar outcomes are achieved at the second end 144 of core 140, where the second force is applied to the core 140 through an interface between the second engagement surface 138 and the second engaged surface 148. In other embodiments, the first engagement surface 118 and second engagement surface 138 can take other forms.

The driving of input end 202 can be done in any conventional fashion. In the embodiment of FIG. 22, input end 202 is shown being driven by actuator 182 which can be, for example and without limitation, a motor.

In many cases, the amount of the first force and the second force applied will be generally constant and the first force and the second force are applied to cause the first end and the second end to maintain a determined average rate of rotation over the course of each rotation of the core 140 unless instructed to change the rate of rotation. Alternatively, the first force and the second force can be applied to cause the first end 142 and the second end 144 to maintain a determined average rotational relationship over the course of each rotation of the core 140.

However, where the inertial load experienced by the core 140 is greater at one of the first end 142 and the second end 144 than at the other of the first end 142 and the second end 144 so that a first component of the inertial load experienced at the first end 142 of the core 140 is at a first level and so that a second component the experienced at the second end during rotation is at a second different level, and wherein the first force and the second force are in proportion to the component of the inertial load experienced at the first end 142 and the second end 144. In such a situation, drive transmission 200 will be adapted to provide such different levels of force.

FIG. 23 shows an alternative embodiment in which drive transmission 200 further comprises a cross-core force conveyor 230 that extends from a side of frame 100 confronting first end 142 of core 140 to a side of frame 100 confronting second end 144 of core 140. Cross-core force conveyor 230 is movable to convey a force from an actuator 182 proximate to first end 142 of core 140 to second end 144. As is shown in the embodiment of FIG. 23, cross-core force conveyor 230 comprises a shaft that is positioned outside of frame 100 and that can rotate in response to a rotational force provided at an input end 202 by actuator 182. In other embodiments, cross-core force conveyor 230 can comprise, without limitation, any of a shaft, a rod, a belt, a chain, or a wire.

As is also shown in FIG. 23, in this embodiment, a first output 204 of drive transmission 200 is provided by a first flexible link 234 between cross-core force conveyor 230 and first end of core 140. In the embodiment illustrated in FIG. 23, first flexible link 234 comprises a belt, however, other forms of flexible interface including but not limited to wires, belts, chains, and flexible tension members can be used.

Similarly, in this embodiment, a second output 210 of drive transmission 200 is provided by a second flexible link 236 between cross-core force conveyor 230 and second end 144 of core 140 of first end 142. In the embodiment illustrated in FIG. 24, first flexible link 234 comprises a belt, however, other forms of flexible interface including but not limited to wires, belts, chains, and flexible tension members can be used.

As is also shown in phantom in FIG. 23 are an alternative first flexible link 234' and an alternative second flexible link 236' that engage first core mounting 110 and second core mounting 130 outside of frame 100.

Figure 24:
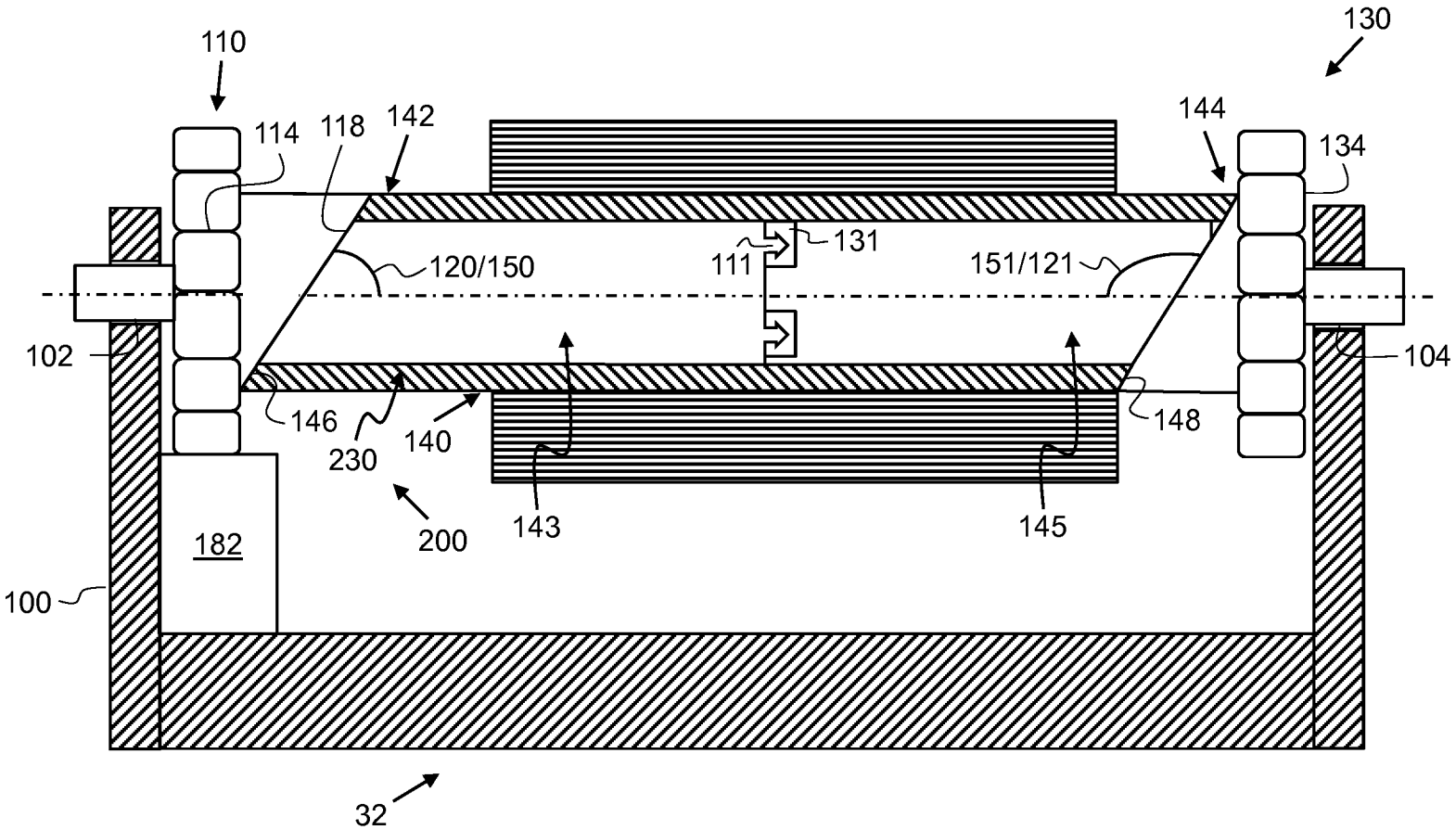
FIG. 24 shows still another embodiment of a web medium supply that controls rotation of a core using a first force that is applied at a first end of the core and a second force applied at a second end of the core.

FIG. 24 shows an alternative embodiment where drive transmission 200 has a cross-core force conveyor 230 that passes through core 140. Here, core 140 has a first open area 143 and a second open area 145 that combine to define a passageway between first end 142 and second end 144 through which first core mounting 110 and second core mounting 130 can extend. In this embodiment, first core mounting 110 and second core mounting 130 can be joined by interfacing members 111 and 131 when the first engagement surface 118 has a first engagement angle 120 that corresponds to a first engaged angle 150 of a first engaged surface 146 and optionally when second engaged surface 148 has a second engaged angle 151 that corresponds to a second engagement angle 121.

In the embodiment of FIG. 24, a drive transmission 200 is formed by the combined first core mounting 110 and second core mounting 130, such that an input force applied to either of first core mounting 110 or second core mounting 130 is distributed between first core mounting 110 and second mounting 130 and will ensure that first end 142 and second end 144 of core 140 maintain a desired rotational positional relationship between first end 142 and second end 144 of core 140.

Figure 25:
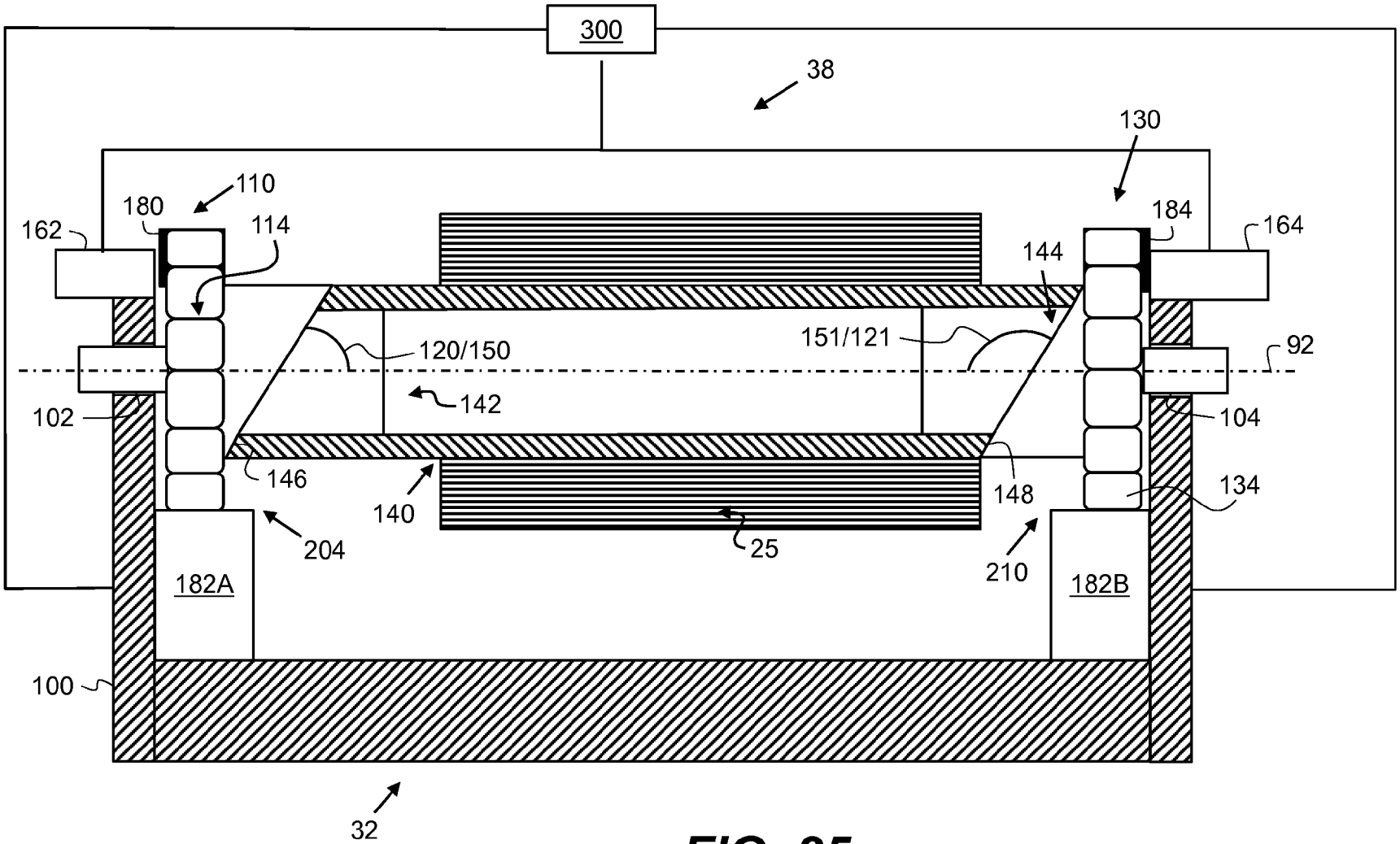
FIG. 25 shows yet another embodiment of a web medium supply that controls rotation of a core using a first force that is applied at a first end of the core and a second force applied at a second end of the core.

FIG. 25 shows yet another embodiment of a web medium supply 32 that can apply a first force to a first end 142 of a core 140 and a second force to second end 144 of core 140. However, in this embodiment a controller 300 uses a first actuator 182A to apply a first force to first core mounting 110 at first output 204 and a second actuator 182B to apply a second force to second core mounting 130 at second output 210. First actuator 182A and second actuator 182B typically comprise motors that can be rotated in response to electrical signals provided thereto. In this regard, in certain embodiments, first actuator 182A and second actuator 182B can comprise stepper motors, or any other conventional direct current or alternating current motors of conventional design. In other embodiments first actuator 182A and second actuator 182B can comprise any other form of electrically controlled actuators that can receive an electrical signal and generate, in response to the received electrical signal, a determined force within a range of available forces that can be applied to first end 142 and second end 144 of core 140 respectively to cause core 140 to rotate.

Similarly, first output 204 and can comprise any known form of linkage between first actuator 182A and first core mounting 110 including but not limited to the types of first output 204 shown in the embodiments above while second output 210 can comprise any known form of linkage between second actuator 182B and second core mounting 130 including but not limited to the embodiments of second output 210 described above.

In the embodiment of FIG. 25, a first sensor 162 senses a condition from which a rotational position of first end 142 of core 140 can be determined and generates a first sensor signal from which the rotational position of the first end 142 of mixing core 140 can be determined. Similarly, a second sensor 164 senses a condition from which a rotational position of a second end 144 of core 140 can be determined and generates a second sensor signal from which the rotational position of the second end 144 of the core 140 can be determined.

First sensor 162 and second sensor 164 can comprise any type of mechanical, electro-mechanical, optical, electrical or magnetic sensor of any type that can sense any condition that is indicative of a rotational position of first end 142 and second end 144 of core 140 and that can provide a first sensor signal and a second sensor signal from which processor 34 can determine the rotational position of first end 142 and second end 144, and can, in certain embodiments comprise any of the embodiments of first sensor 162 and second sensor 164 described above and can be used for both the purposes described above and those described here.

As is shown in the embodiment of FIG. 25, controller 300 receives the first sensor signal and the second sensor signal and generates a first control signal causing first actuator 182A to operate so that a first force is applied to first core mounting 110 and from first core mounting 110 to the first end 142 of core 140. Controller 300 also generates a second control signal causing second actuator 184B to operate so that a second force is applied to second core mounting 130 and from second core mounting 130 to the second end 144 of the core 140. The first force and second force work together to control rotation of core 140 against any inertial loads created by the mass of core 140 and web 25.

Controller 300 can comprise any form of control circuit or system that can receive the first sensor signal from first sensor 162 and the second sensor 164 of sensor system 38 and can determine the relative rotation position of first end 142 and second end 144 of core 140, and based upon this determination, can determine a first control signal to send to first actuator 182A and a second control signal to send to second actuator 182B cause rotation of core 140 as described herein. In this regard, controller 300 can comprise any known type of logic or control circuit including but not limited to a processor, a micro-controller, a micro-processor, or hardwired control logic circuit. Controller 300 is responsive to processor 34 to supply web 25 as required by processor 34. In certain embodiments processor 34 can be used as controller 300.

It will be appreciated that in general, during steady state rotation of a core/mounting assembly it will be desirable for controller 300 to generate signals that are calculated to cause first actuator 182A and second actuator 182B to apply equal amounts of force to each of first core mounting 110 and second core mounting 130. However, this may not always be a desirable operational model. For example, as is shown and discussed above in certain circumstances the steady state rotation of a core mounting/mounting assembly may require application as different levels of force at different ends of such a core/mounting assembly.

Further, it may be useful for a controller 300 to have a steady state of rotational operation wherein the first control signal and second control signal cause the first end 142 of the core 140 and the second end 144 of the core 140 to remain within a range of rotational positions relative to each other with the range being defined so that differences in the rotational positions of the first end 142 and the second end 144 are created that cause a determined range of shear stress to exist in the core 140. Such rotation induced shear stress is used to stiffen a core 140 being rotated in this manner as may be desirable under certain loading conditions, rotation rates or printing conditions. For example, the shear stress can be achieved when the first force causes first core mounting 110 to apply force through first engagement surface 118 and the second force causes the second core mounting 130 to apply force through second engagement surface 138 to respectively drive first engaged surface 146 and first engagement surface 146 to have a different rotational separation during rotation than they have in an initial unloaded state.

Typically, this desired positional relationship is one where any differences between the rotational position of first end 142 and the rotational position of the second end 244 are maintained at a target level. In certain embodiments, the target can be a zero difference level. However, in other embodiments, the target level can include an offset level.

There are a variety of ways in which the desired positional relationship can be maintained once established. For example, the first force and the second force can be applied to cause the first end 142 and the second end 144 to maintain a determined average rotational positional relationship over the course of each rotation of the core 140. In another example, the first force and the second force can be applied to cause the first end 142 and the second end 144 to maintain the desired positional relationship by maintaining a determined average rate of rotational velocity at the ends of the core 140 over the course of each rotation of the core 140. These averages have been described in terms of frequency of rotation, however, it will be appreciated that these averages can be equivalently calculated or described in terms of units of time, phase or other similar expressions.

In situations where it is desired that a core 140 be made stiffer the first force and the second force are applied in a manner that causes a shear stress to be induced in the core 140. Typically this occurs where the forces are unequal. However, depending on the inertial load on core 140 and the relative arrangements of core 140, first core mounting 110, second core mounting 130 and web 25 it is possible to create a stiffening shear stress in core 140 even when the first force and second force are equal.

The amount of stiffening of core 140, driven in accordance with this embodiment, can be defined as a function of the extent to which the rotational positions of first end 142 and second end 144 are offset from an initial state, with more shear stress and accordingly more stiffening of core 140 when there is less correspondence with the initial state.

It will further be appreciated that in certain embodiments the extent to which such an offset is tolerated or required can be a function of the elasticity of the material from which core 140 is fabricated. That is, where core 140 is made using elastic materials a greater range of variation can be tolerated when the core 140 is fabricated using more elastic materials, while a lesser range of variation can be tolerated when the core 140 is fabricated using less elastic materials.

An advantage of allowing a greater range of elastic variation for a core 140 that is more elastic is that fewer control adjustments may be required. For example, the first force and the second force can be applied to cause a difference to occur in the rotational positions of the first end 142 and the second end 144 that create a first portion of the shear stress in core 140 while the inertial load induces a second portion of the shear stress in core 140. Where this is done, controller 300 can cause first actuator 182A and second actuator 182B to provide the first force and the second force so that the first portion is less than half of the total shear stress induced in the core 140 during rotation. This allows core 140 to be stiffened for example before attempting to adjust a position of core 140 and web 25 such that adjustment of the rotational position of core 140 and web 25 can be made in a manner that is more responsive to the timing or extent of the applied first force and the second force than would be possible for an unstiffened core 140. Additionally, the stiffness can be adjusted as a function of an anticipated inertial load such as where controller 300 is instructed to change a rate of rotation of core 140 or to initiate rotation from a stopped state. In such a case, the inertial load to be experienced can be anticipated and the stiffening of core 140 can be adjusted in anticipation, and the first force and second force required at a level that will cause the anticipated inertial load.

Alternatively, the stiffening of the core 140 can be used to reduce an ability of the core to flex perpendicular to an axis of rotation while rotating against the inertial load to reduce the extent of any additional load caused by any friction that can be experienced by the core when the core is allowed to flex perpendicular to an axis of rotation to an extent that is sufficient to bring the core into contact with the web medium supply. Further, the stiffening of core 140 can also reduce the extent of any curvature in core 140 along the axis of rotation that can come to exist in core 140 as a product of manufacture or fabrication methods used to make core 140 or as a product of post manufacture handling.

It will be appreciated that the embodiments of FIGS. 22, 23 and 24 can also be used to create a stiffening of core 140. For example, in the embodiment of FIG. 22, an input force can be distributed by drive transmission 200 so that the first force and the second force are applied to create a limited shear stress that stiffens core 140 by differentially driving the first end 142 and second end 144. Here too, a first portion of a total shear stress induced by an inertial or other load on core 140 can be created in this manner that is less than half of the total shear stress induced in the core 140 during rotation.

Figure 26A:
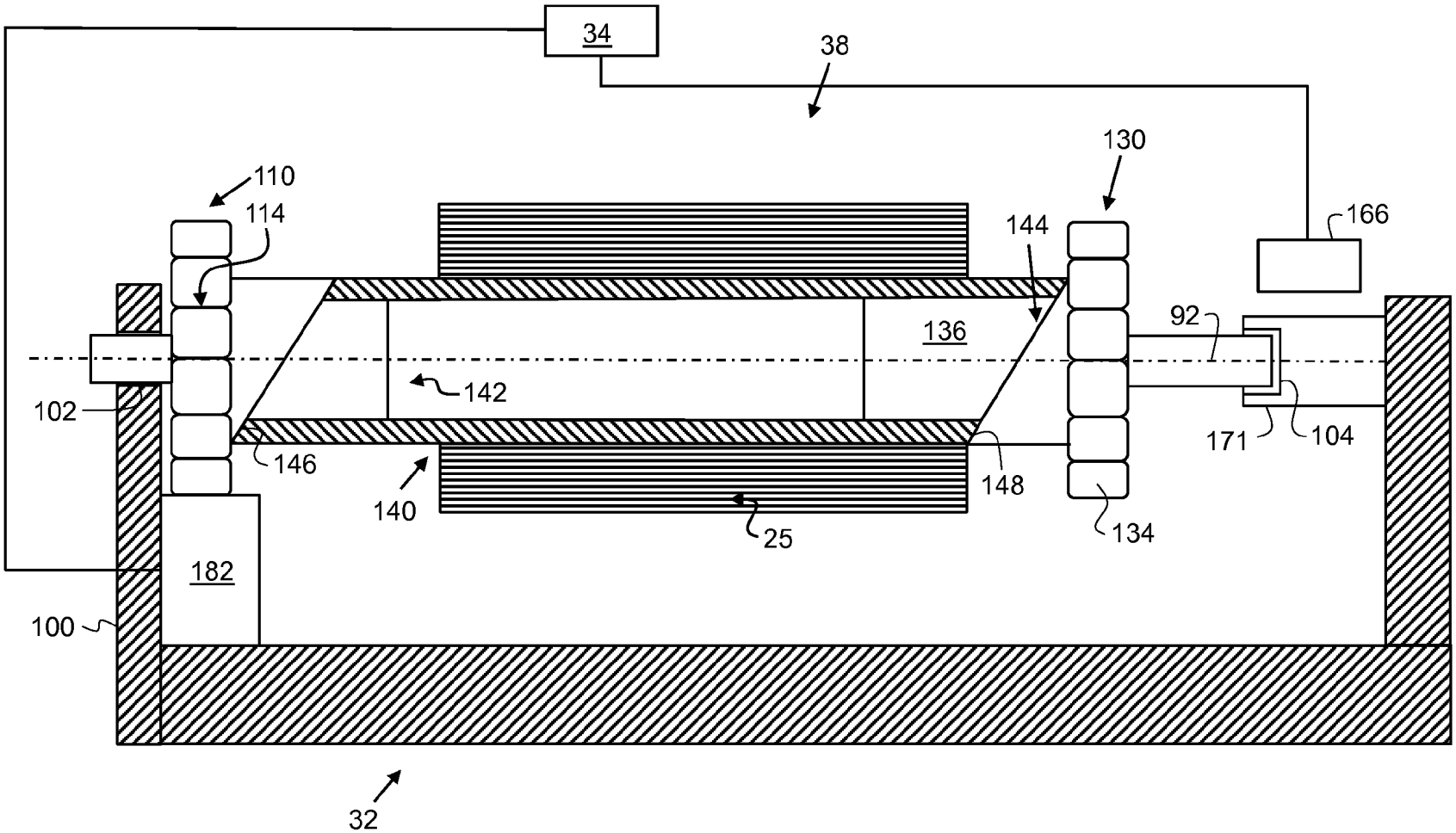
FIGS. 26A and 26B illustrate yet another embodiment of a web medium supply.
Figure 26B:
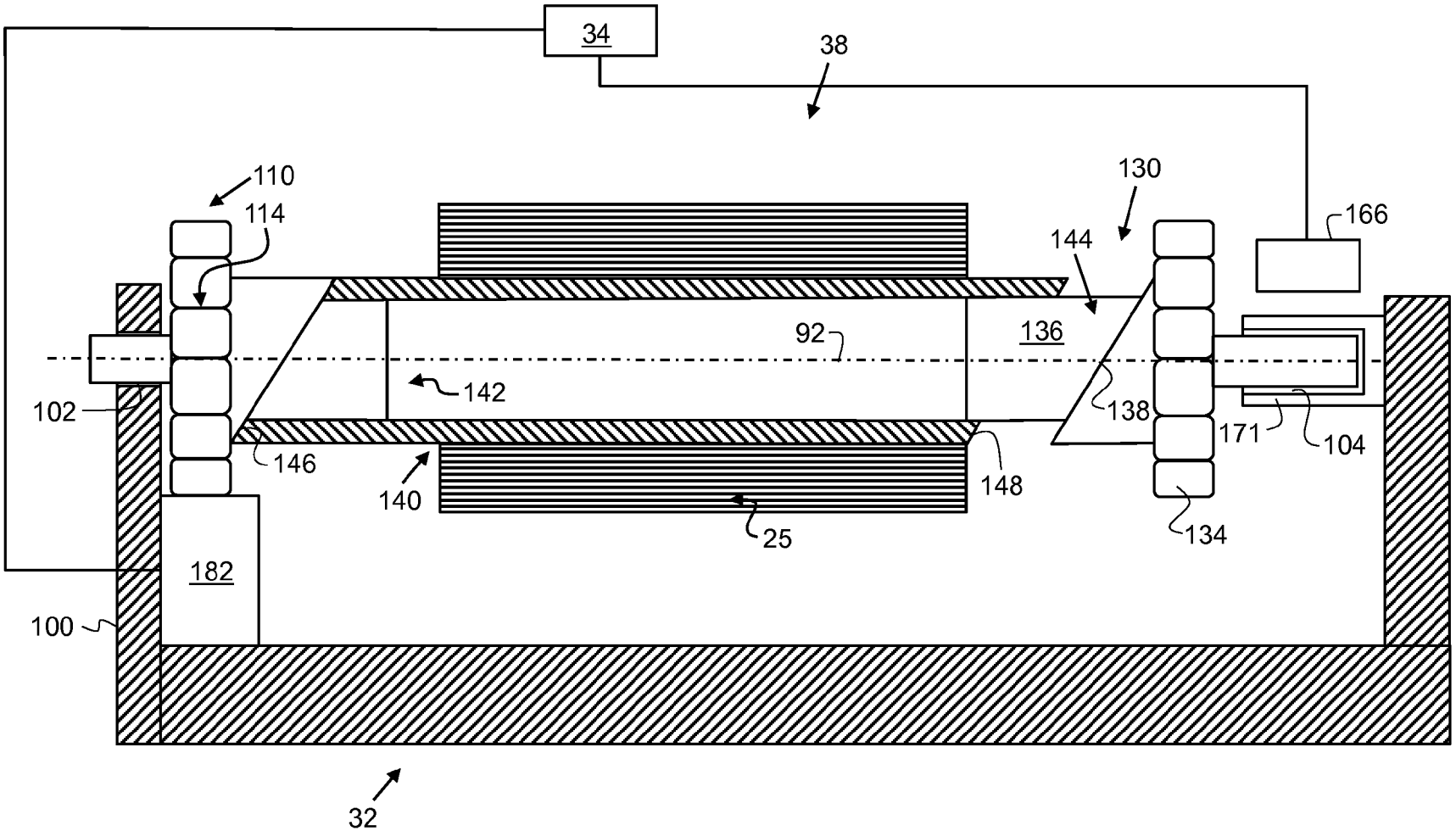

FIGS. 26A and 2B illustrate another embodiment of the web medium supply 32 wherein and the second core mounting 130 is movable along the axis of rotation 92 between a range of driving positions where second core mounting moves in phase with second engagement surface 148 and a range of slip positions one example of which is shown in FIG. 26A. As is shown in FIGS. 26A and 26B a biasing member is provided that urges e second core mounting toward the range of mounting positions. In the event that an amount of torque is applied between second end of core 144 and second core mounting 130 that is above a predetermined threshold this torque is converted at the interface between second engagement surface 138 and second engaged surface 148 into a force that drives second core mounting 130 against the bias force to extent that is sufficient to allow second core mounting 130 and second engagement surface 148 have different rates of rotation. An example of this is shown in FIG. 26B, where second core mounting 130 has been urge along the axis for rotation 92 by an extent sufficient to all to this to occur. As is also shown in FIG. 26B, second core mounting surface 136 extends sufficiently into second end 144 of core 140 to allow core 140 to continue to rotate along axis of rotation 92. When the torque diminishes, the urging of the biasing member drives second core mounting 130 such that second engagement surface 138 and second engaged surface 148 reengage. Also shown in FIGS. 26A and 26B is a sensor 166 that can detect when second core mounting 130 is moved to the range of slip positions, thus allowing processor 34 to detect when this occurs so that processor 34 can adjust control inputs as necessary.

Methods for Operating a Web Medium Supply

Figure 27:
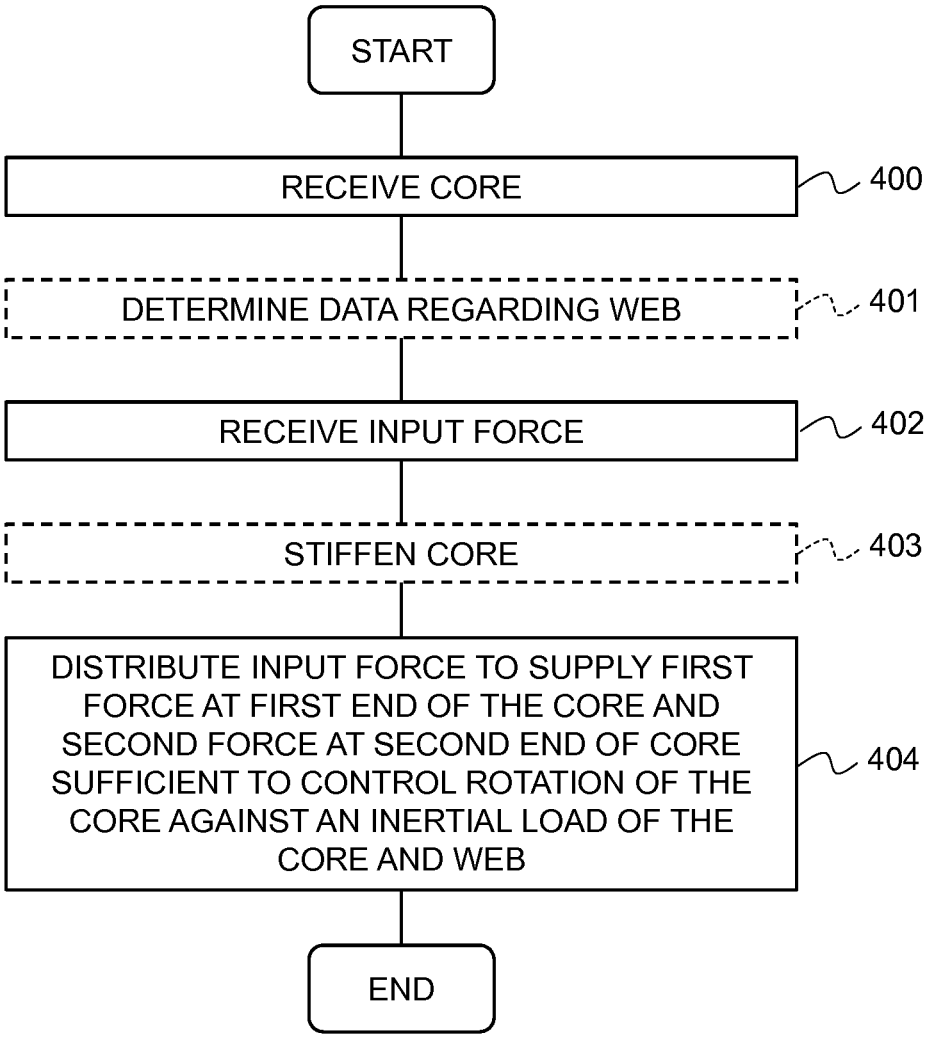
FIG. 27 shows one embodiment of a method for operation a web medium supply.

FIG. 27 shows a first embodiment of a method for operating a development station. It will be appreciated that this method can be implemented automatically by way of electronic or mechanical logic and control systems such as those that are described above.

As is shown in FIG. 27, in the first embodiment, a core is received and mounted in web medium supply 32 (step 400), an input force is received (step 402) and the input force is then distributed (step 404) to the first end 142 and to the second end 144 of the core 140 as a first force that is applied to first end 142 of the core 140 and as a second force that is applied to a second end 144 of core 140. In this embodiment, the first force and the second force are sufficient to control rotation of core 140 against an inertial load created by the mass of core 140 and the web 25.

Further, as is discussed above, both the first force and the second force are less than a third force applied a single driven end of an alternative core control related the alternative core against the inertial load. Accordingly, a core used with this method can have a first yield strength at the first end 142 and a second yield strength at the second end 144 that are less than a third yield strength required to receive the third force at the driven end of the alternative core.

An optional step of automatically determining data from the core is also shown (step 401). This method step can be performed using, for example, the embodiments described in FIGS. 16-22. Further, an optional step of stiffening core 140 can also be performed (step 403). This stiffening of core 140 can be created, by applying the first force to the first end and the second force to the second end as is generally described above to cause the first end 142 and the second end 144 have an offset from an initial rotational separation therebetween. This offset can be established before rotation of core 140 or during rotation. The offset can be fixed or can vary as is also described generally above.

Figure 28:
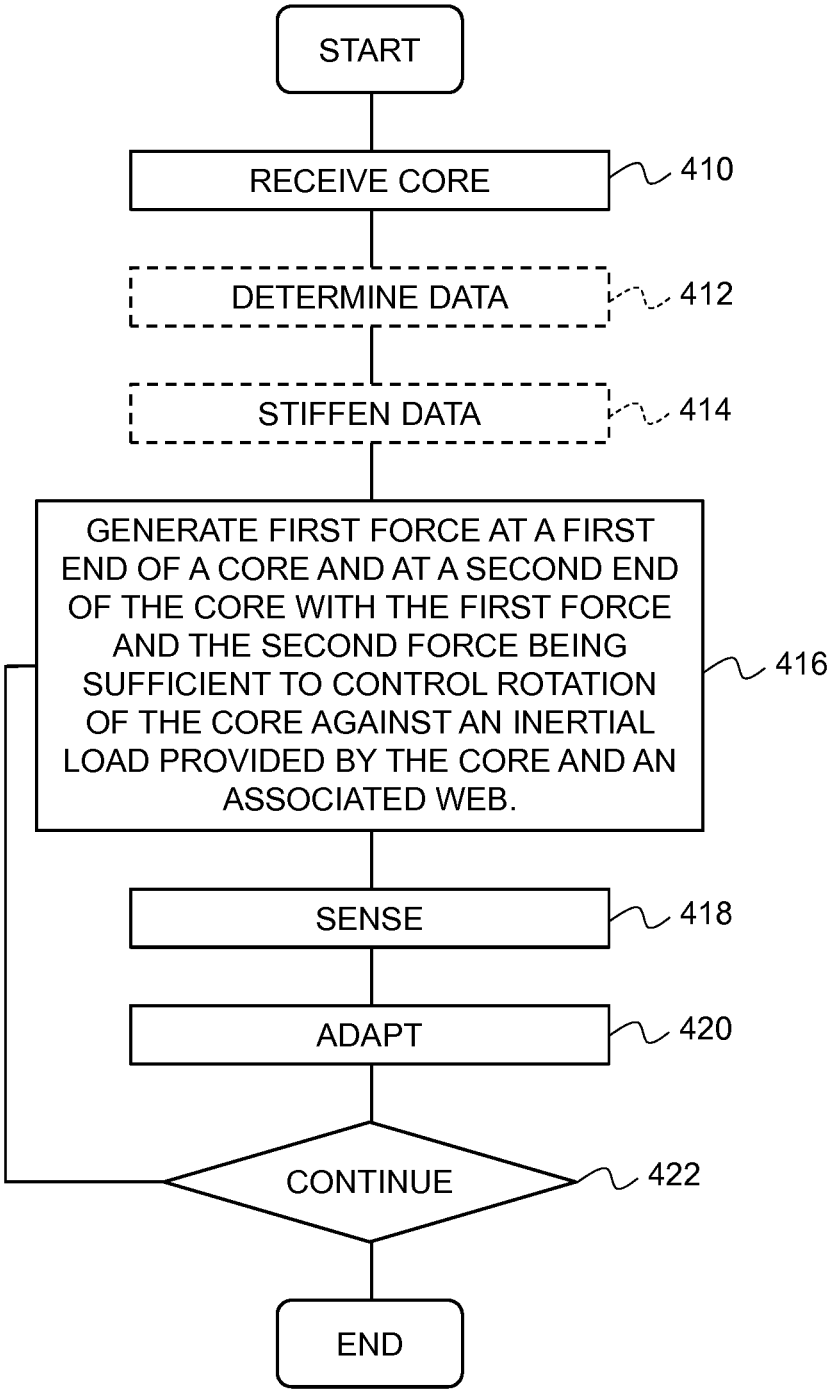
FIG. 28 shows another embodiment of a method for operation a web medium supply.

As is shown in FIG. 28, a second embodiment of a method for operating a web medium supply 23 to control rotation of a core 140 having a web is provided. In a first step of this method, a core is received (step 410), data regarding the core is optionally determined (step 412), a first force is applied to a first end 142 of core 140 using a first actuator 182A and a second force is applied to a second end 144 of core 140 using a second actuator 182B (step 416) to control rotation of core 140 and web 25.

In this embodiment, the first force and the second force are sufficient to control rotation of core 140 against an inertial load created by the core 140 and web 25. Further, as is discussed above, both the first force and the second force are less than a third force that would be applied at a single driven end of an alternative core to rotate the alternative core against the inertial load. Further, core 140 can have a first yield strength at the first end 142 and a second yield strength at the second end 144 that are less than a third yield strength required to receive the third force at the driven end of the alternative core. The amount of the first force and the second force can be determined by signals generated by controller 300.

The application of the first force and the second force can optionally be applied to controllably stiffen core 140 (step 414). As is discussed above, this stiffening of core 140 can be induced by applying forces that drive the first end 142 of the core 140 and the second end 144 of core 140 to have relative rotational positions that are different than the rotational positions of the first end 142 of core 140 and the second end 144 of core 140 at an initial state. As noted above, it can be useful to adjust the tension in core 140 so as to enhance the performance of the core. For example, when there is a situation where core 140 and web 25 must be driven in a manner that will induce high inertial loads if can be useful to pre-stiffen core 140. Accordingly, it can be beneficial to perform the stiffening step (step 414) by receiving a signal to indicating that operation conditions are to be such that tension is useful and in response to such signal, increasing tension in the core before initiating a change in velocity of the core 140 and web 25.

Also shown in the embodiment of FIG. 27, are the additional steps of sensing a rotational position of the first end, sensing a rotational position of the second end (step 418) and adapting the first force and the second force based upon the sensed rotational position of the first end 142 and the sensed rotational position of the second end 144 (step 420). These steps can be performed generally in the same manner described above with reference to FIG. 18. To the extent that controller 310 determines that the core 140 is to continue rotating, this process can be repeated (step 422).

It will be appreciated that by providing a web medium supply 32 having the dual end drive in FIGS. 22-23 arranged or driven by a core according to the methods described in FIGS. 22-28 as described herein any of a number of the following technical effects can be achieved:

For example, the methods and web medium supplies 32 described herein enable web to include core 140 having a volume that provides the first yield strength at the first end and the second yield strength end but that is less than the volume of the alternative core providing the third yield strength so that more volume is available a printer for web 25 than would be available if the alternative core is used.

Similarly, the methods and web medium supplies 32 described herein enable a radius of a core having the first yield strength and the second yield strength to be less than a radius of the alternative core providing the third yield strength at the driven end, so that a volume of web 25 supplied on core 140 creates less angular momentum than an equivalent amount of web 25 would create if supplied on the alternative core.

Additionally, the methods and web medium supplies 32 described in FIGS. 22-28 can be used to enable a radius of a core providing the first yield strength and the second yield strength to be less than a radius of the alternative core providing the third yield strength, so that the volume of a printer in which the core is used operates can be made smaller than the volume of a development station in which the alternative core operates while supplying certain amount of web 25. This can occur both because the radius of the core is smaller and because the core 140 is stiffened to help ensure that the core 140 and web 25 rotate along an axis of rotation 92.

Still further, the methods and web medium supplies 32 described in FIGS. 22-28 can enable a core 140 to be made from a first material that provides the first yield strength and second yield strength in a determined configuration, but must be made using a second material that is more dense than the first material to provide the third yield strength to make the alternative core in the determined configuration. Similarly, the methods and web medium supplies 32 provided in FIGS. 22-28 allow a core 140 can be made from a first material that provides the first yield strength and second yield strength in a determined configuration, but must be made using a second material that is more rigid than the first material to provide the third yield strength to make the alternative core in the determined configuration.

The invention has been described in detail with particular reference to certain preferred embodiments thereof, but it will be understood that variations and modifications can be effected within the scope of the invention.

What is claimed is:

1. A web medium supply for a web medium on a core, the web medium supply comprising;

a frame having a first mounting support and a second mounting support that are positioned along an axis of rotation and separated by a separation distance during the supply of the web;

a first core mounting having a first surface that is rotatably supportable by the first mounting support about the axis of rotation and a first engagement end to which a first end of a core can be mounted and a first engagement surface through which a first force urging the core to rotate can be transmitted to the core to urge the core to rotate with the first core mounting; and a second core mounting having a second surface that is rotatably supportable by the second mounting support about the axis of rotation and a second engagement end to which a second end of the core can be mounted and a second engagement surface through which a second force urging the second core to rotate can be transmitted to the core to urge the core to rotate with the second core mounting; and a drive transmission having an input end to receive an input force, a first output mechanically linked for movement with the first core mounting and a second output mechanically linked for movement with the second core mounting with the drive transmission mechanically linking the input end to the first output and to the second output and distributing an amount of force supplied at the input end between the first force and the second force, such that the first force and the second force can, in combination, rotate the first core mounting, second core mounting, the core and any web wound thereon against an inertial load of the core and web;

wherein both the first force and the second force are less than a third force that is sufficient to drive an alternative core against the inertial load from one driven end, and wherein the core has a first yield strength at the first end and a second yield strength at the second end that are each less than a third yield strength that is required to receive the third force at the driven end of the alternative core.

2. The web medium supply claim 1, wherein a volume of the core providing the first yield strength and the second yield strength is less than a volume of the alternative core providing the third yield strength at the driven end so that more volume is available in the web medium supply for web medium than would be available if the alternative core is used.

3. The web medium supply of claim 1, wherein a radius of the core that provides the first yield strength and the second yield strength is less than a radius of the alternative core providing the third yield strength at a driven end of the alternative core, so that a volume of web supplied by the core creates less angular momentum than the same volume of web would create if supplied by the alternative core.

4. The web medium supply of claim 1, wherein a radius of the core providing the first yield strength and the second yield strength is less than a radius of the alternative core providing the third yield strength, so that the volume of a web medium supply in which the core operates can be made smaller than the volume of a web medium supply in which the alternative core operates still supplying a given volume web.

5. The web medium supply of claim 1, wherein a volume of the shaft of the core having the first yield strength and second yield strength is smaller than a volume of an alternative shaft of the alternative core that provides the third yield strength while using the same material for fabrication of the core and for fabrication of the alternative core.

6. The web medium supply of claim 1, wherein the core can be made using a first material that provides the first yield strength and second yield strength in a determined configuration, but must be made using a second material that is more dense than the first material to provide the third yield strength to make the alternative core in the determined configuration.

7. The web medium supply of claim 1, wherein the core can be made from a first material that provides the first yield strength and second yield strength in a determined configuration, but must be made using a second material that is more rigid than the first material to provide the third yield strength to make the alternative core in the determined configuration.

8. The web medium supply of claim 1, wherein the drive transmission causes the first output and the second output to cause the first end of the core and the second end of the core to remain within a range of rotational positions relative to each other with the range being defined so that differences in the rotational positions of the first end and second end create a determined range of shear stress in the core.

9. The web medium supply of claim 1, wherein the core has an interior passageway from the first end of the core to the second end of the core and where the web medium supply further comprises the steps of mounting a first end of the core to a first core mounting and a second end of the core to a second core mounting and mechanically linking the first core mounting to the second core mounting within the interior passageway of the core such that a portion of an input force can be transferred from a first end of the core to a second end of the core through the mechanical linkage of the first core mounting and the second core mounting.

10. The web medium supply of claim 1, wherein at least one of the first core mounting and the second core mounting are movable along the axis of rotation relative to between a range of driving positions and a range of slip positions, and further comprising a biasing member urging the one of the first core mounting and the second core mounting toward the range of mounting positions.

11. The web medium supply of claim 10, wherein the bias on the at least one of the first core mounting and the second core mounting is such that the core and the mounting slip relative each other when a torque in excess of a predetermined level is applied at the intersection.

* * * * *